US010870042B2

(12) United States Patent
Wahl et al.

(10) Patent No.: US 10,870,042 B2
(45) **Date of Patent: *Dec. 22, 2020**

(54) IRON TYPE GOLF CLUB HEAD

(71) Applicant: Taylor Made Golf Company, Inc., Carlsbad, CA (US)

(72) Inventors: Bret H. Wahl, Escondido, CA (US); Scott Taylor, Bonita, CA (US); Peter L. Larsen, San Marcos, CA (US); Joshua J. Dipert, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/788,133

(22) Filed: Feb. 11, 2020

(65) Prior Publication Data

US 2020/0206585 A1 Jul. 2, 2020

Related U.S. Application Data

(63) Continuation of application No. 16/522,509, filed on Jul. 25, 2019, now Pat. No. 10,610,749, which is a continuation of application No. 15/840,922, filed on Dec. 13, 2017, now Pat. No. 10,406,410, which is a continuation of application No. 15/448,927, filed on Mar. 3, 2017, now Pat. No. 9,849,357, which is a continuation of application No. 14/719,054, filed on (Continued)

(51) Int. Cl.

| | |
|---|---|
| ***A63B 53/04*** | (2015.01) |
| ***A63B 60/52*** | (2015.01) |
| ***A63B 60/54*** | (2015.01) |
| ***A63B 60/50*** | (2015.01) |
| ***A63B 53/00*** | (2015.01) |

(52) U.S. Cl.

CPC ..... *A63B 53/047* (2013.01); *A63B 53/0475* (2013.01); *A63B 60/52* (2015.10); *A63B 53/005* (2020.08); *A63B 53/0408* (2020.08); *A63B 53/0412* (2020.08); *A63B 53/0433* (2020.08); *A63B 53/0462* (2020.08); *A63B 60/50* (2015.10); *A63B 60/54* (2015.10)

(58) Field of Classification Search

CPC ... A63B 53/047; A63B 53/0475; A63B 60/52; A63B 60/54; A63B 2053/0462; A63B 2053/005; A63B 2053/0433; A63B 2053/0412; A63B 2053/0408; A63B 60/50

USPC ..... 473/324–350, 287–292

See application file for complete search history.

(56) References Cited

U.S. PATENT DOCUMENTS

| | | | |
|---|---|---|---|
| 4,398,965 | A | 8/1983 | Campau |
| 7,582,024 | B2 | 9/2009 | Shear |

(Continued)

*Primary Examiner* — Sebastiano Passaniti

(74) *Attorney, Agent, or Firm* — Klarquist Sparkman LLP

(57) ABSTRACT

Iron-type golf club heads are disclosed having a heel portion, a sole portion, a toe portion, a top-line portion, a front portion, a rear portion, and a striking face. The iron-type golf club heads include a flexible boundary structure ("FBS") that is provided at one or more locations on the club head. The flexible boundary structure may comprise, in several embodiments, a slot, a channel, a gap, a thinned or weakened region, or other structure that enhances the capability of an adjacent or related portion of the golf club head to flex or deflect and to thereby provide a desired improvement in the performance of the golf club head.

20 Claims, 31 Drawing Sheets

Related U.S. Application Data

May 21, 2015, now Pat. No. 9,623,299, which is a continuation of application No. 13/830,293, filed on Mar. 14, 2013, now Pat. No. 9,044,653.

(60) Provisional application No. 61/657,675, filed on Jun. 8, 2012.

(56) References Cited

U.S. PATENT DOCUMENTS

| | | | | |
|---|---|---|---|---|
| 8,088,025 | B2 | 1/2012 | Wahl et al. | |
| 8,206,241 | B2 | 6/2012 | Boyd | |
| 8,235,841 | B2 | 8/2012 | Stites | |
| 8,235,844 | B2 | 8/2012 | Albertsen | |
| 8,403,771 | B1 | 3/2013 | Rice | |
| 8,529,368 | B2 | 9/2013 | Rice | |
| 8,834,289 | B2 | 9/2014 | De La Cruz | |
| 8,834,290 | B2 | 9/2014 | Bezilla | |
| 8,900,069 | B2 | 12/2014 | Beach | |
| 8,956,242 | B2 | 2/2015 | Rice | |
| 8,961,332 | B2 | 2/2015 | Galvan | |
| 8,986,133 | B2 | 3/2015 | Bennett | |
| 8,998,746 | B2 | 4/2015 | Boyd et al. | |
| 9,033,813 | B2 | 5/2015 | Oldknow | |
| 9,044,653 | B2 | 6/2015 | Wahl | |
| 9,089,747 | B2 | 7/2015 | Boyd | |
| 9,101,808 | B2 | 8/2015 | Stites | |
| 9,211,448 | B2 | 12/2015 | Bezilla | |
| 9,211,451 | B1 * | 12/2015 | Westrum | A63B 60/42 |
| 9,216,324 | B2 | 12/2015 | Shear | |
| 9,320,948 | B2 | 4/2016 | Fossum | |
| 9,320,949 | B2 | 4/2016 | Golden | |
| 9,409,067 | B2 | 8/2016 | De La Cruz | |
| 9,492,722 | B2 | 11/2016 | Taylor et al. | |
| 9,526,956 | B2 | 12/2016 | Murphy | |
| 9,561,408 | B2 | 2/2017 | Bezilla | |
| 9,561,410 | B2 | 2/2017 | Bennett | |
| 9,623,299 | B2 | 4/2017 | Wahl | |
| 9,636,552 | B2 | 5/2017 | Cleghorn | |
| 9,636,559 | B2 | 5/2017 | De La Cruz | |
| 9,675,852 | B2 * | 6/2017 | Westrum | A63B 60/00 |
| 9,731,176 | B2 | 8/2017 | Issertell et al. | |
| 9,776,057 | B2 | 10/2017 | Rice et al. | |
| 9,849,357 | B2 | 12/2017 | Wahl | |
| 9,937,395 | B2 | 4/2018 | Taylor et al. | |
| 10,071,294 | B2 | 9/2018 | Oldknow et al. | |
| 10,080,934 | B2 * | 9/2018 | Beach | A63B 53/02 |
| 10,406,410 | B2 | 9/2019 | Wahl et al. | |
| 10,427,014 | B2 | 10/2019 | Taylor et al. | |
| 10,610,749 | B2 * | 4/2020 | Wahl | A63B 53/0475 |
| 2007/0026961 | A1 | 2/2007 | Hou | |
| 2011/0028240 | A1 | 2/2011 | Wahl et al. | |
| 2012/0142452 | A1 | 6/2012 | Burnett | |
| 2013/0165254 | A1 | 6/2013 | Rice | |
| 2020/0030673 | A1 * | 1/2020 | Sasamoto | A63B 1/00 |

* cited by examiner

IRON TYPE GOLF CLUB HEAD

CROSS-REFERENCE TO RELATED APPLICATIONS

This application is a continuation of U.S. patent application Ser. No. 16/522,509, filed Jul. 25, 2019, which is a continuation of U.S. patent application Ser. No. 15/840,922, filed Dec. 13, 2017, which is a continuation of U.S. patent application Ser. No. 15/448,927, filed Mar. 3, 2017, which is a continuation of U.S. patent application Ser. No. 14/719,054, filed May 21, 2015, which is a continuation of U.S. patent application Ser. No. 13/830,293, filed Mar. 14, 2013 (now U.S. Pat. No. 9,044,653, which issued on Jun. 2, 2015), which claims priority to and benefit of U.S. Provisional Patent Application No. 61/657,675, filed Jun. 8, 2012. All of these applications are incorporated by reference herein in their entireties.

FIELD

The present disclosure relates to golf club heads, golf clubs, and sets of golf clubs. More specifically, the present disclosure relates to golf club heads for iron type golf clubs, and golf clubs and sets of golf clubs including such golf club heads.

BACKGROUND

A golf set includes various types of clubs for use in different conditions or circumstances in which a ball is hit during a golf game. A set of clubs typically includes a "driver" for hitting the ball the longest distance on a course. A fairway "wood" can be used for hitting the ball shorter distances than the driver. A set of irons are used for hitting the ball within a range of distances typically shorter than the driver or woods. Every club has an ideal striking location or "sweet spot" that represents the best hitting zone on the face for maximizing the probability of the golfer achieving the best and most predictable shot using the particular club.

An iron has a flat face that normally contacts the ball whenever the ball is being hit with the iron. Irons have angled faces for achieving lofts ranging from about 18 degrees to about 64 degrees. The size of an iron's sweet spot is generally related to the size (i.e., surface area) of the iron's striking face, and iron sets are available with oversize club heads to provide a large sweet spot that is desirable to many golfers. Most golfers strive to make contact with the ball inside the sweet spot to achieve a desired ball speed, distance, and trajectory.

Conventional "blade" type irons have been largely displaced (especially for novice golfers) by so-called "perimeter weighted" irons, which include "cavity-back" and "hollow" iron designs. Cavity-back irons have a cavity directly behind the striking plate, which permits club head mass to be distributed about the perimeter of the striking plate, and such clubs tend to be more forgiving to off-center hits. Hollow irons have features similar to cavity-back irons, but the cavity is enclosed by a rear wall to form a hollow region behind the striking plate. Perimeter weighted, cavity back, and hollow iron designs permit club designers to redistribute club head mass to achieve intended playing characteristics associated with, for example, placement of club head center of mass or a moment of inertia. These designs also permit club designers to provide striking plates that have relatively large face areas that are unsupported by the main body of the golf club head.

SUMMARY OF THE DESCRIPTION

The present disclosure describes iron type golf club heads typically comprising a head body and a striking plate. The head body includes a heel portion, a toe portion, a topline portion, a sole portion, and a hosel configured to attach the club head to a shaft. In some embodiments, the head body defines a front opening configured to receive the striking plate at a front rim formed around a periphery of the front opening. In other embodiments, the striking plate is formed integrally (such as by casting) with the head body.

Some embodiments of the iron type golf club heads include a flexible boundary structure ("FBS") provided at one or more locations on the club head. The flexible boundary structure may comprise, in several embodiments, a slot, a channel, a gap, a thinned or weakened region, or other structure that enhances the capability of an adjacent or related portion of the golf club head to flex or deflect and to thereby provide a desired improvement in the performance of the golf club head.

In a first aspect, a clubhead for an iron-type golf club includes a body having a heel portion, a sole portion, a toe portion, a top-line portion, and a face portion, with the sole portion extending rearwardly from a lower end of the face portion. The face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane. In the coordinate system, a positive x-axis extends toward the heel portion from the origin, a positive y-axis extends rearwardly from the origin, and a positive z-axis extends upwardly from the origin. The body includes a central region in which $-25\ \text{mm}<x<25\ \text{mm}$. The sole portion that is contained within the central region includes a forward sole region located adjacent to the face portion and a sole bar located rearward of the forward sole region, with the forward sole region defining a wall having a minimum forward sole thickness $T_{FS}$ and the sole bar defining a body having a maximum sole bar thickness $T_{SB}$, such that $0.05<T_{FS}/T_{SB}<0.4$. The sole bar defines a first channel extending in a substantially heel-to-toe direction of the sole portion and having a first channel opening located on a bottom surface of the sole bar.

In some embodiments, the first channel has a first channel length comprising the distance between a part of the first channel nearest the toe portion and a part of the first channel nearest the heel region, with the first channel length being from about 15 mm to about 85 mm. In some additional embodiments, the first channel length is from about 30 mm to about 57 mm.

In some embodiments, the first channel has a first channel depth comprising a vertical distance between the ground plane and an uppermost point of the first channel, with an average of the first channel depth within the central region being from about 5 mm to about 25 mm. In some additional embodiments, the first channel depth is substantially constant within the central region.

In some embodiments, the body includes a toe side region wherein the x-axis coordinate is less than −25 mm, and a heel side region wherein the x-axis coordinate is greater than 25 mm, and the first channel has an average depth in the central region that is less than an average depth of the first channel in the toe side region. In some further embodiments, the first channel has an average depth in the central region that is less than an average depth of the first channel in the heel side region. Still further, in some embodiments, the first channel has an average depth in the central region that is less than an average depth of the first channel in the toe side region and that is less than an average depth of the first channel in the heel side region. In still other embodiments, the first channel has an average depth in the central region that is greater than an average depth of the first channel in the toe side region. In still other embodiments, the first channel has an average depth in the central region that is greater than an average depth of the first channel in the heel side region. In still other embodiments, the first channel has an average depth in the central region that is greater than an average depth of the first channel in the toe side region and that is greater than an average depth of the first channel in the heel side region.

In some embodiments, the sole bar defines a second channel extending in a substantially heel-to-toe direction of the sole bar and having a second channel opening located on an upper surface of the sole bar, the second channel having a second channel length, a second channel depth, and a second channel width.

In some embodiments, the central region of the body is defined as: $-20$ mm$<x<20$ mm. In still other embodiments, the central region of the body is defined as: $-15$ mm$<x<15$ mm.

In some embodiments, 0.8 mm$<T_{FS}<3.0$ mm. In still other embodiments, 1.0 mm$<T_{FS}<2.5$ mm.

In some embodiments, the first channel has a first channel length L1, the body has a sole length $L_B$, and a ratio of the first channel length to the sole length satisfies the following inequality: $0.35<L\mathbf{1}/L_B<0.67$.

In some embodiments, the first channel defines a first channel depth H1 that comprises the vertical distance from the ground plane to the uppermost point of the first channel, the body defines a body height $H_{CH}$ that comprises the vertical distance from the ground plane to the uppermost point of the body, and a ratio of an average value of the first channel depth H1 within the central region to the body height $H_{CH}$ satisfies the following inequality: $0.07<H\mathbf{1}_{AVG}/H_{CH}<0.50$.

In some embodiments, the first channel defines a first channel centerline and the face portion defines a face plane. In these embodiments, projections of the first channel centerline and the face plane onto the ground plane define a face to channel distance D1, the sole portion defines a sole width D3, and a ratio of an average value of the face to channel distance D1 within the central region to an average value of the sole width D3 within the central region satisfies the following inequality: $0.15<D\mathbf{1}/D\mathbf{3}<0.71$.

In some embodiments, the body defines an interior cavity, and the body has a volume V that satisfies the following inequality: 10 cc$<V<$120 cc. In some of these embodiments, the body has a volume V that satisfies the following inequality: 40 cc$<V<$90 cc. In some of these embodiments, the body has a volume V that satisfies the following inequality: 60 cc$<V<$80 cc.

In some embodiments, the body defines a clubhead depth, $D_{CH}$ that satisfies the following inequality: 15 cc$<D_{CH}<$100 cc. In some of these embodiments, the body has a clubhead depth that satisfies the following inequality: 30 cc$<D_{CH}<$80 cc. In some of these embodiments, the body has a clubhead depth that satisfies the following inequality: 40 cc$<D_{CH}<$70 cc.

In some embodiments, a filler material is located in the first channel.

In a second aspect, a clubhead for an iron-type golf club includes a body having a heel portion, a sole portion, a toe portion, a top-line portion, and a face portion, with the sole portion extending rearwardly from a lower end of the face portion. The face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane. In the coordinate system, a positive x-axis extends toward the heel portion from the origin, a positive y-axis extends rearwardly from the origin, and a positive z-axis extends upwardly from the origin. The body includes a central region in which $-25$ mm$<x<25$ mm. The sole portion that is contained within the central region includes a forward sole region located adjacent to the face portion and a sole bar located rearward of the forward sole region, the sole bar defining a first channel extending in a substantially heel-to-toe direction of the sole portion and having a first channel opening located on a bottom surface of the sole bar. The first channel defines a first channel centerline and the face portion defines a face plane, such that projections of the first channel centerline and the face plane onto the ground plane define a face to channel distance D1. The sole portion defines a sole width D3. A ratio of an average value of the face to channel distance D1 within the central region to an average value of the sole width D3 within the central region satisfies the following inequality: $0.15<D\mathbf{1}/D\mathbf{3}<0.71$.

In some embodiments, the forward sole region defines a wall having a minimum forward sole thickness $T_{FS}$ and the sole bar defines a body having a maximum sole bar thickness $T_{SB}$, such that $0.05<T_{FS}/T_{SB}<0.4$.

In some embodiments, 0.8 mm$<T_{FS}<3.0$ mm. In still other embodiments, 1.0 mm$<T_{FS}<2.5$ mm.

In some embodiments, the first channel has a first channel length L1, the body has a sole length $L_B$, and a ratio of the first channel length to the sole length satisfies the following inequality: $0.35<L\mathbf{1}/L_B<0.67$.

In some embodiments, the first channel defines a first channel depth H1 that comprises the vertical distance from the ground plane to the uppermost point of the first channel, the body defines a body height $H_{CH}$ that comprises the vertical distance from the ground plane to the uppermost point of the body, and a ratio of an average value of the first channel depth H1 within the central region to the body height $H_{CH}$ satisfies the following inequality: $0.07<H\mathbf{1}_{AVG}/H_{CH}<0.50$.

In some embodiments, the body defines an interior cavity, and the body has a volume V that satisfies the following inequality: 10 cc$<V<$120 cc. In some of these embodiments, the body has a volume V that satisfies the following inequality: 40 cc$<V<$90 cc. In some of these embodiments, the body has a volume V that satisfies the following inequality: 60 cc$<V<$80 cc.

In some embodiments, the body defines a clubhead depth, $D_{CH}$ that satisfies the following inequality: 15 cc$<D_{CH}<$100 cc. In some of these embodiments, the body has a clubhead depth that satisfies the following inequality: 30 cc$<D_{CH}<$80 cc. In some of these embodiments, the body has a clubhead depth that satisfies the following inequality: 40 cc$<D_{CH}<$70 cc.

In some embodiments, a filler material is located in the first channel.

In a third aspect, a clubhead for an iron-type golf club includes a body having a heel portion, a sole portion, a toe portion, a top-line portion, and a face portion, with the sole portion extending rearwardly from a lower end of the face portion. The face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane. In the coordinate system, a positive x-axis extends toward the heel portion from the origin, a positive y-axis extends rearwardly from the origin, and a positive z-axis extends upwardly from the origin. The sole portion includes a forward sole region located adjacent to the face portion and a sole bar located rearward of the forward sole region, with the sole bar defining a first channel extending in a substantially heel-to-toe direction of the sole portion and having a first channel opening located on a bottom surface of the sole bar. The first channel has a first channel length L1, the body has a sole length $L_B$, and a ratio of the first channel length to the sole length satisfies the following inequality: $0.35<L1/L_B<0.67$.

In some embodiments, the forward sole region defines a wall having a minimum forward sole thickness $T_{FS}$ and the sole bar defines a body having a maximum sole bar thickness $T_{SB}$, such that $0.05<T_{FS}/T_{SB}<0.4$.

In some embodiments, 0.8 mm$<T_{FS}<$3.0 mm. In still other embodiments, 1.0 mm$<T_{FS}<$2.5 mm.

In some embodiments, the first channel defines a first channel depth H1 that comprises the vertical distance from the ground plane to the uppermost point of the first channel, the body defines a body height $H_{CH}$ that comprises the vertical distance from the ground plane to the uppermost point of the body, and a ratio of an average value of the first channel depth H1 within the central region to the body height $H_{CH}$ satisfies the following inequality: $0.07<H1_{AVG}/H_{CH}<0.50$.

In some embodiments, the body defines an interior cavity, and the body has a volume V that satisfies the following inequality: 10 cc<V<120 cc. In some of these embodiments, the body has a volume V that satisfies the following inequality: 40 cc<V<90 cc. In some of these embodiments, the body has a volume V that satisfies the following inequality: 60 cc<V<80 cc.

In some embodiments, the body defines a clubhead depth, $D_{CH}$ that satisfies the following inequality: 15 cc$<D_{CH}<$100 cc. In some of these embodiments, the body has a clubhead depth that satisfies the following inequality: 30 cc$<D_{CH}<$80 cc. In some of these embodiments, the body has a clubhead depth that satisfies the following inequality: 40 cc$<D_{CH}<$70 cc.

In some embodiments, a filler material is located in the first channel.

In a fourth aspect, a clubhead for an iron-type golf club includes a body having a heel portion, a sole portion, a toe portion, a top-line portion, and a face portion, with the sole portion extending rearwardly from a lower end of the face portion. The face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane. In the coordinate system, a positive x-axis extends toward the heel portion from the origin, a positive y-axis extends rearwardly from the origin, and a positive z-axis extends upwardly from the origin. The body includes a central region in which −25 mm<x<25 mm. The sole portion that is contained within the central region includes a forward sole region located adjacent to the face portion and a sole bar located rearward of the forward sole region, the sole bar defining a first channel extending in a substantially heel-to-toe direction of the sole portion and having a first channel opening located on a bottom surface of the sole bar. The first channel defines a first channel depth H1 that comprises the vertical distance from the ground plane to the uppermost point of the first channel, the body defines a body height $H_{CH}$ that comprises the vertical distance from the ground plane to the uppermost point of the body, and a ratio of an average value of the first channel depth H1 within the central region to the body height $H_{CH}$ satisfies the following inequality: $0.07<H1_{AVG}/H_{CH}<0.50$.

In some embodiments, the forward sole region defines a wall having a minimum forward sole thickness $T_{FS}$ and the sole bar defines a body having a maximum sole bar thickness $T_{SB}$, such that $0.05<T_{FS}/T_{SB}<0.4$.

In some embodiments, 0.8 mm$<T_{FS}<$3.0 mm. In still other embodiments, 1.0 mm$<T_{FS}<$2.5 mm.

In some embodiments, the first channel has a first channel length L1, the body has a sole length $L_B$, and a ratio of the first channel length to the sole length satisfies the following inequality: $0.35<L1/L_B<0.67$.

In some embodiments, the body defines an interior cavity, and the body has a volume V that satisfies the following inequality: 10 cc<V<120 cc. In some of these embodiments, the body has a volume V that satisfies the following inequality: 40 cc<V<90 cc. In some of these embodiments, the body has a volume V that satisfies the following inequality: 60 cc<V<80 cc.

In some embodiments, the body defines a clubhead depth, $D_{CH}$ that satisfies the following inequality: 15 cc$<D_{CH}<$100 cc. In some of these embodiments, the body has a clubhead depth that satisfies the following inequality: 30 cc$<D_{CH}<$80 cc. In some of these embodiments, the body has a clubhead depth that satisfies the following inequality: 40 cc$<D_{CH}<$70 cc.

In some embodiments, a filler material is located in the first channel.

In a fifth aspect, a set of iron-type golf clubs includes a first subset of at least one iron-type golf club and a second subset of at least one iron-type golf club. The first subset includes at least one club head with a loft that is less than or equal to 30°, a face portion, a heel portion, a toe portion, a sole portion, and a top-line portion, with the sole portion defining a flexible boundary structure comprising a slot or a channel having a length of from about 15 mm to about 85 mm. The second subset includes at least one club head with a loft that is greater than 30°, a face portion, a heel portion, a toe portion, a sole portion, and a top-line portion, with the sole portion having no flexible boundary structure comprising a slot or a channel having a length of from about 15 mm to about 85 mm.

In some embodiments, the first subset includes at least two golf clubs, at least three golf clubs, at least four golf clubs, or at least five golf clubs. In some embodiments, the second subset includes at least two golf clubs, at least three golf clubs, at least four golf clubs, or at least five golf clubs.

In some embodiments, each of the golf clubs of the first subset includes a body having a heel portion, a sole portion, a toe portion, a top-line portion, and a face portion, with the sole portion extending rearwardly from a lower end of the face portion. The face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane. In the coordinate system, a positive x-axis extends toward the heel portion from the origin, a positive y-axis extends rearwardly from the origin, and a positive z-axis extends upwardly from the origin. The body includes a central region in which −25 mm<x<25 mm. The sole portion that is contained within the central region includes a forward sole region located adjacent to the face portion and a sole bar located rearward of the forward sole region, with the forward sole region defining a wall having a minimum forward sole thickness $T_{FS}$ and the sole bar defining a body having a maximum sole bar thickness $T_{SB}$, such that $0.05<T_{FS}/T_{SB}<0.4$. The sole bar defines a first channel extending in a substantially heel-to-toe direction of the sole portion and having a first channel opening located on a bottom surface of the sole bar.

In some embodiments, 0.8 mm<$T_{FS}$<3.0 mm. In still other embodiments, 1.0 mm<$T_{FS}$<2.5 mm.

In some embodiments, the first channel has a first channel length L1, the body has a sole length $L_B$, and a ratio of the first channel length to the sole length satisfies the following inequality: $0.35<L1/L_B<0.67$.

In some embodiments, the first channel defines a first channel depth H1 that comprises the vertical distance from the ground plane to the uppermost point of the first channel, the body defines a body height $H_{CH}$ that comprises the vertical distance from the ground plane to the uppermost point of the body, and a ratio of an average value of the first channel depth H1 within the central region to the body height $H_{CH}$ satisfies the following inequality: $0.07<H1_{AVG}/H_{CH}<0.50$.

In some embodiments, the first channel defines a first channel centerline and the face portion defines a face plane. In these embodiments, projections of the first channel centerline and the face plane onto the ground plane define a face to channel distance D1, the sole portion defines a sole width D3, and a ratio of an average value of the face to channel distance D1 within the central region to an average value of the sole width D3 within the central region satisfies the following inequality: 0.15<D1/D3<0.71.

In some embodiments, the body defines an interior cavity, and the body has a volume V that satisfies the following inequality: 10 cc<V<120 cc. In some of these embodiments, the body has a volume V that satisfies the following inequality: 40 cc<V<90 cc. In some of these embodiments, the body has a volume V that satisfies the following inequality: 60 cc<V<80 cc.

In some embodiments, the body defines a clubhead depth, $D_{CH}$ that satisfies the following inequality: 15 cc<$D_{CH}$<100 cc. In some of these embodiments, the body has a clubhead depth that satisfies the following inequality: 30 cc<$D_{CH}$<80 cc. In some of these embodiments, the body has a clubhead depth that satisfies the following inequality: 40 cc<$D_{CH}$<70 cc.

In a sixth aspect, a clubhead for an iron-type golf club includes a body having a heel portion, a sole portion, a toe portion, a top-line portion, and a face portion, wherein said sole portion extends rearwardly from a lower end of said face portion, the body further defining a rear void. The face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane. In the coordinate system, a positive x-axis extends toward the heel portion from the origin, a positive y-axis extends rearwardly from the origin, and a positive z-axis extends upwardly from the origin. The body includes a central region in which −25 mm<x<25 mm. The sole portion that is contained within the central region includes a forward sole region located adjacent to the face portion and a sole bar located rearward of the forward sole region, with the forward sole region defining a wall having a minimum forward sole thickness $T_{FS}$ and the sole bar defining a body having a maximum sole bar thickness $T_{SB}$, such that $0.05<T_{FS}/T_{SB}<0.4$. The sole portion includes a slot extending in a substantially heel-to-toe direction of the sole portion, the slot defining a portion of a path that extends through the sole portion and into the rear void.

In some embodiments, the slot has a slot length comprising the distance between a part of the slot nearest the toe portion and a part of the slot nearest the heel region, with the slot length being from about 15 mm to about 85 mm.

In some embodiments, 0.8 mm<$T_{FS}$<3.0 mm.

In some embodiments, the slot has a slot length L1, the body has a sole length $L_B$, and a ratio of the slot length to the sole length satisfies the following inequality: $0.35<L1/L_B<0.67$.

In some embodiments, the body defines an interior cavity, and the body has a volume V that satisfies the following inequality: 10 cc<V<120 cc.

In some embodiments, a filler material is located in the slot.

In some embodiments, the face portion defines a face plane and the path includes a lower path portion having a length of at least 1 mm and defining a lower path angle that is within 30° of being parallel with said face plane, an intermediate path portion having a length of at least 1 mm and defining an intermediate path angle that is within 30° of being perpendicular to said face plane, and an upper path portion having a length of at least 1 mm and defining an upper path angle that is within 30° of being parallel with said face plane.

In a seventh aspect, a clubhead for an iron-type golf club includes a body having a heel portion, a sole portion, a toe portion, a top-line portion, and a face portion, wherein said sole portion extends rearwardly from a lower end of said face portion, the body further defining a rear void. The face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane. In the coordinate system, a positive x-axis extends toward the heel portion from the origin, a positive y-axis extends rearwardly from the origin, and a positive z-axis extends upwardly from the origin. The body includes a central region in which −25 mm<x<25 mm. The sole portion that is contained within the central region includes a forward sole region located adjacent to the face portion and a sole bar located rearward of the forward sole region, with the forward sole region defining a wall having a minimum forward sole thickness $T_{FS}$ and the sole bar defining a body having a maximum sole bar thickness $T_{SB}$. The sole portion includes a slot extending in a substantially heel-to-toe direction of the sole portion, the slot defining a portion of a path that extends through the sole portion and into the rear void, with the path including a lower path portion having a length of at least 1 mm and defining a lower path angle that is within 30° of being parallel with said face plane, an intermediate path portion having a length of at least 1 mm and defining an intermediate path angle that is within 30° of being perpendicular to said face plane, and an upper path portion having a length of at least 1 mm and defining an upper path angle that is within 30° of being parallel with said face plane.

In some embodiments, the slot has a slot length comprising the distance between a part of the slot nearest the toe portion and a part of the slot nearest the heel region, with the slot length being from about 15 mm to about 85 mm.

In some embodiments, 0.8 mm$<T_{FS}<$3.0 mm.

In some embodiments, the slot has a slot length L1, the body has a sole length $L_B$, and a ratio of the slot length to the sole length satisfies the following inequality: $0.35<L1/L_B<0.67$.

In some embodiments, the body defines an interior cavity, and the body has a volume V that satisfies the following inequality: 10 cc<V<120 cc.

In some embodiments, a filler material is located in the slot.

The foregoing and other features and advantages of the golf club heads described herein will become more apparent from the following detailed description, which proceeds with reference to the accompanying figures.

BRIEF DESCRIPTION OF THE DRAWINGS

The present invention is illustrated by way of example and not limitation in the figures of the accompanying drawings in which like references indicate similar elements.

DETAILED DESCRIPTION

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

As used herein, the terms "coefficient of restitution," "COR," "relative coefficient of restitution," "relative COR," "characteristic time," and "CT" are defined according to the following. The coefficient of restitution (COR) of an iron clubhead is measured according to procedures described by the USGA Rules of Golf as specified in the "Interim Procedure for Measuring the Coefficient of Restitution of an Iron Clubhead Relative to a Baseline Plate," Revision 1.2, Nov. 30, 2005 (hereinafter "the USGA COR Procedure"). Specifically, a COR value for a baseline calibration plate is first determined, then a COR value for an iron clubhead is determined using golf balls from the same dozen(s) used in the baseline plate calibration. The measured calibration plate COR value is then subtracted from the measured iron clubhead COR to obtain the "relative COR" of the iron clubhead.

To illustrate by way of an example: following the USGA COR Procedure, a given set of golf balls may produce a measured COR value for a baseline calibration plate of 0.845. Using the same set of golf balls, an iron clubhead may produce a measured COR value of 0.825. In this example, the relative COR for the iron clubhead is 0.825−0.845=−

0.020. This iron clubhead has a COR that is 0.020 lower than the COR of the baseline calibration plate, or a relative COR of −0.020.

The characteristic time (CT) is the contact time between a metal mass attached to a pendulum that strikes the face center of the golf club head at a low speed under conditions prescribed by the USGA club conformance standards.

As used herein, the term "volume" when used to refer to a golf clubhead refers to a clubhead volume measured according to the procedure described in Section 5.0 of the "Procedure For Measuring the Clubhead Size of Wood Clubs," Revision 1.0.0, published Nov. 21, 2003 by the United States Golf Association (the USGA) and R&A Rules Limited. The foregoing procedure includes submerging a clubhead in a large volume container of water. In the case of a volume measurement of a hollow iron type clubhead, any holes or openings in the walls of the clubhead are to be covered or otherwise sealed prior to lowering the clubhead into the water.

1. Iron Type Golf Club Heads

Figure 1A:
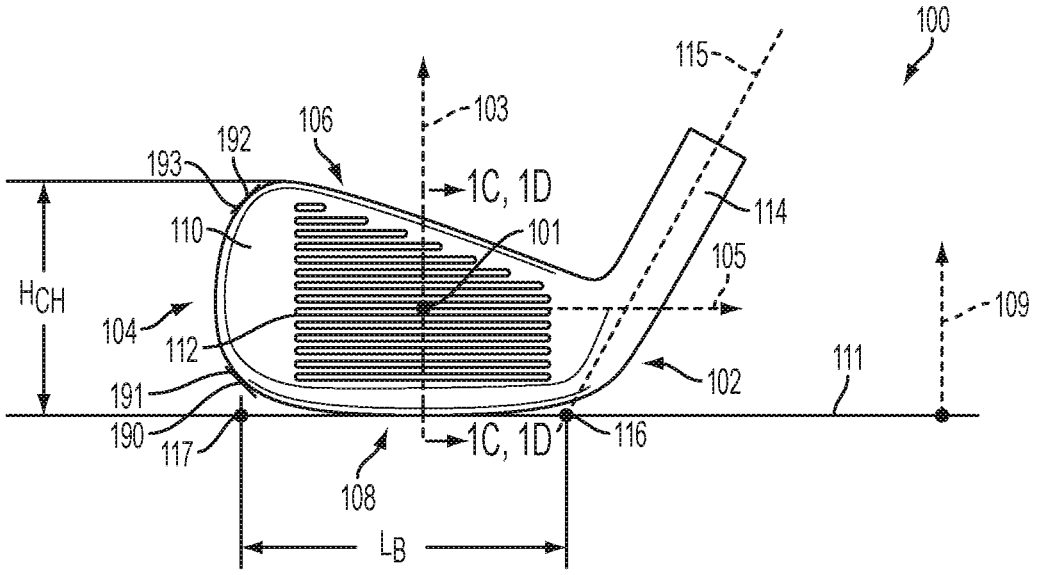
FIG. 1A is a front view of an embodiment of a golf club head.

FIG. 1A illustrates an iron type golf club head 100 including a body 113 having a heel 102, a toe 104, a sole portion 108, a top line portion 106, and a hosel 114. The golf club head 100 is shown in FIG. 1A in a normal address position with the sole portion 108 resting upon a ground plane 111, which is assumed to be perfectly flat. As used herein, "normal address position" means the club head position wherein a vector normal to the center of the club face substantially lies in a first vertical plane (i.e., a vertical plane is perpendicular to the ground plane 111), a centerline axis 115 of the hosel 114 substantially lies in a second vertical plane, and the first vertical plane and the second vertical plane substantially perpendicularly intersect. The center of the club face is determined using the procedures described in the USGA "Procedure for Measuring the Flexibility of a Golf Clubhead," Revision 2.0, Mar. 25, 2005.

A lower tangent point 190 on the outer surface of the club head 100 of a line 191 forming a 45° angle relative to the ground plane 111 defines a demarcation boundary between the sole portion 108 and the toe 104. Similarly, an upper tangent point 192 on the outer surface of the club head 100 of a line 193 forming a 45° angle relative to the ground plane 111 defines a demarcation boundary between the top line portion 106 and the toe 104. In other words, the portion of the club head that is above and to the left (as viewed in FIG. 1A) of the lower tangent point 190 and below and to the left (as viewed in FIG. 1A) of the upper tangent point 192 is the toe portion 104.

Figure 1B:
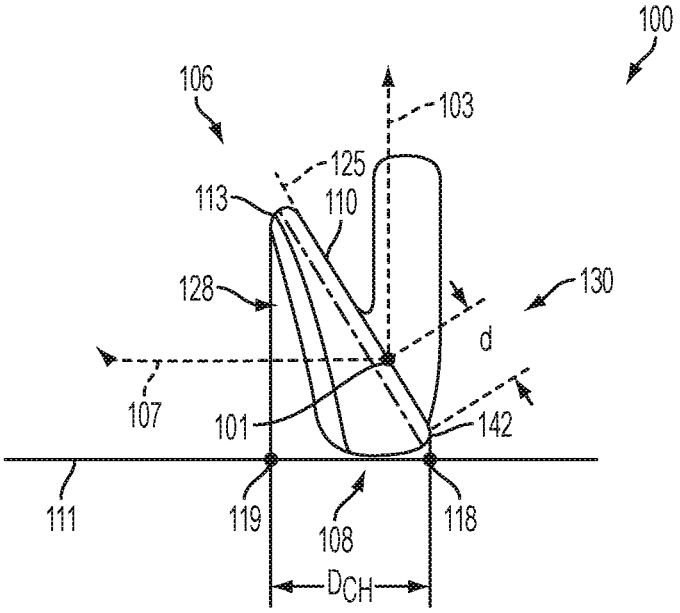
FIG. 1B is an elevated toe perspective view of a golf club head.
Figure 1C:
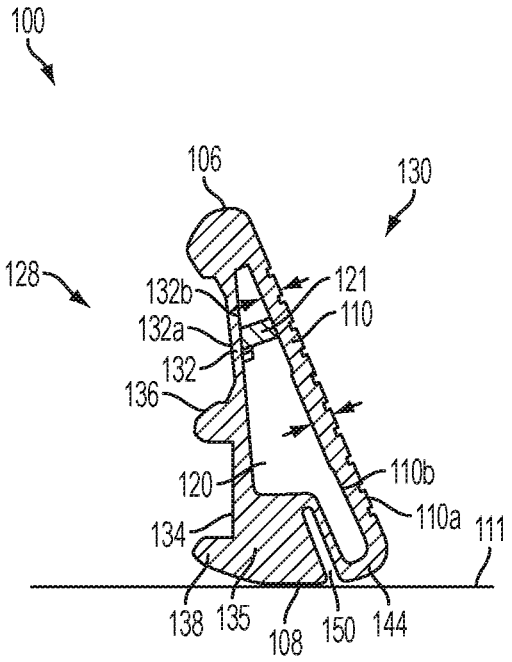
FIG. 1C is a cross-sectional view taken along section lines 1B-1B in FIG. 1A, showing an embodiment of a hollow club head.
Figure 1D:
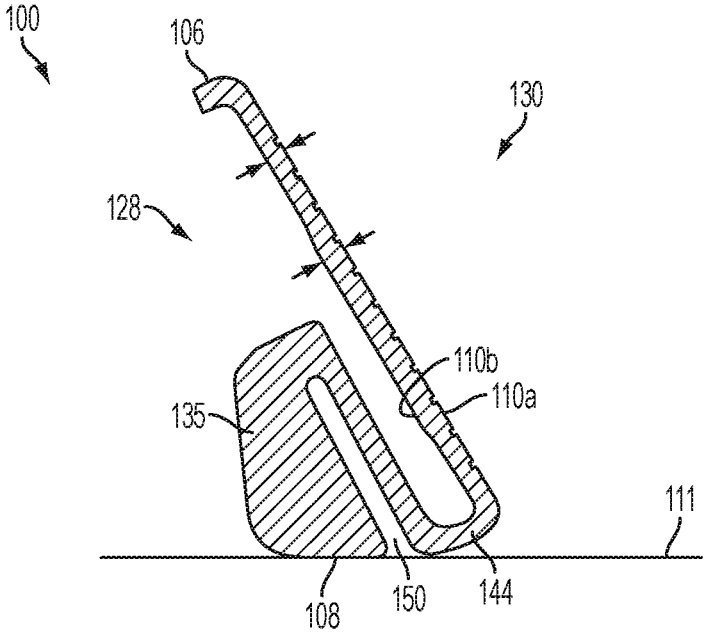
FIG. 1D is a cross-sectional view taken along section lines 1B-1B in FIG. 1A, showing an embodiment of a cavity back club head.
Figure 1E:
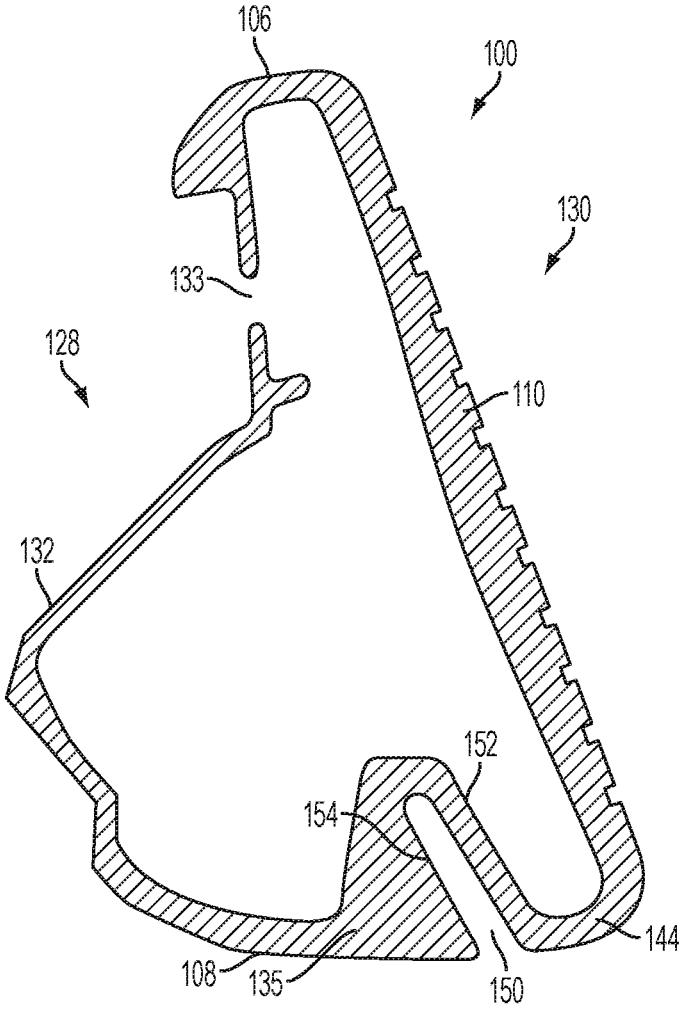
FIG. 1E is a cross-sectional view taken along section lines 1B-1B in FIG. 1A, showing another embodiment of a hollow club head.
Figure 1F:
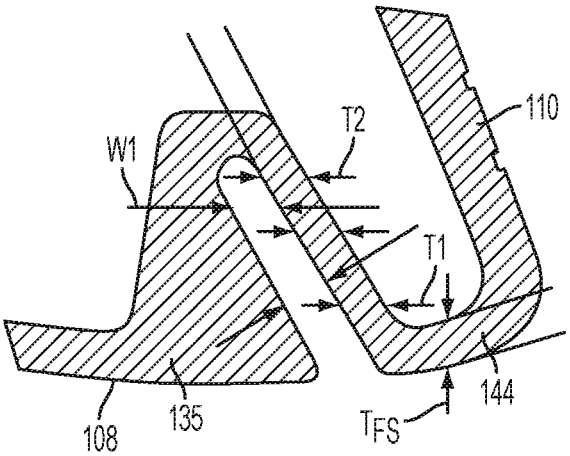
FIG. 1F is a cross-sectional view showing a portion of the embodiment of the hollow club head shown in FIG. 1E.

In certain embodiments such as that shown in FIGS. 1C, 1D, and 1E, the striking face 110 may vary in thickness and have a minimum face thickness and a maximum face thickness. In certain embodiments, the minimum face thickness may be between about 1.5 mm and about 2.5 mm, with a preferred thickness of about 2 mm or less. The maximum face thickness may be between about 1.7 mm and about 2.5 mm or less than about 2.7 mm. In some embodiments the minimum face may be within a range of about 1.0 mm-3.0 mm, preferably 1.5-2.5 mm, and also preferably in a range of about 1.6-2.0 mm.

The striking face 110 defines a face plane 125 and includes grooves 112 that are designed for impact with the golf ball. In some embodiments, the golf club head 100 can be a single unitary cast piece, while in other embodiments, a striking plate can be formed separately to be adhesively or mechanically attached to the body 113 of the golf club head 100.

FIGS. 1A and 1B also show an ideal striking location 101 on the striking face 110 and respective orthogonal CG axes. As used herein, the ideal striking location 101 is located within the face plane 125 and coincides with the location of the center of gravity (CG) of the golf club head along the CG x-axis 105 (i.e., CG-x) and is offset from the leading edge 142 (defined as the midpoint of a radius connecting the sole portion 108 and the face plane 125) by a distance d of 16.5 mm within the face plane 125, as shown in FIG. 1B. A CG x-axis 105, CG y-axis 107, and CG z-axis 103 intersect at the ideal striking location 101, which defines the origin of the orthogonal CG axes. With the golf club head 100 in the normal address position, the CG x-axis 105 is parallel to the ground plane 111 and is oriented perpendicular to a normal extending from the striking face 110 at the ideal striking location 101. The CG y-axis 107 is also parallel to the ground plane and is perpendicular to the CG x-axis 105. The CG z-axis 103 is oriented perpendicular to the ground plane. In addition, a CG z-up axis 109 is defined as an axis perpendicular to the ground plane 111 and having an origin at the ground plane 111.

In certain embodiments, a desirable CG-y location is between about 0.25 mm to about 20 mm along the CG y-axis 107 toward the rear portion of the club head. Additionally, a desirable CG-z location is between about 12 mm to about 25 mm along the CG z-up axis 109, as previously described.

The golf club head may be of solid (i.e., "blades" and "musclebacks"), hollow, cavity back, or other construction. FIG. 1C shows a cross sectional side view along the cross-section lines 1C-1C shown in FIG. 1A of an embodiment of the golf club head having a hollow construction. FIG. 1D shows a cross sectional side view along the cross-section lines 1D-1D of an embodiment of a golf club head having a cavity back construction. The cross-section lines 1C, 1D-1C, 1D are taken through the ideal striking location 101 on the striking face 110. The striking face 110 includes a front surface 110*a* and a rear surface 110*b*. Both the hollow iron golf club head and cavity back iron golf club head embodiments further includes a back portion 128 and a front portion 130.

In the embodiments shown in FIGS. 1A-1D, the grooves 112 are located on the striking face 110 such that they are centered along the CG x-axis about the ideal striking location 101, i.e., such that the ideal striking location 101 is located within the striking face plane 125 on an imaginary line that is both perpendicular to and that passes through the midpoint of the longest score-line groove 112. In other embodiments (not shown in the drawings), the grooves 112 may be shifted along the CG x-axis to the toe side or the heel side relative to the ideal striking location 101, the grooves 112 may be aligned along an axis that is not parallel to the ground plane 111, the grooves 112 may have discontinuities along their lengths, or the grooves may not be present at all. Still other shapes, alignments, and/or orientations of grooves 112 on the surface of the striking face 110 are also possible.

In reference to FIG. 1A, the clubhead 100 has a sole length, $L_B$, and a clubhead height, $H_{CH}$. The sole length, $L_B$, is defined as the distance between two points projected onto the ground plane 111. A heel side 116 of the sole is defined as the intersection of a projection of the hosel axis 115 onto the ground plane 111. A toe side 117 of the sole is defined as the intersection point of the vertical projection of the lower tangent point 190 (described above) onto the ground plane 111. The distance between the heel side 116 and toe side 117 of the sole is the sole length $L_B$ of the clubhead. The clubhead height, $H_{CH}$, is defined as the distance between the ground plane 111 and the uppermost point of the clubhead as projected in the x-z plane, as illustrated in FIG. 1A. FIG. 1B illustrates an elevated toe view of the golf club head 100 including a back portion 128, a front portion 130, a sole portion 108, a top line portion 106, and a striking face 110, as previously described. A leading edge 142 is defined by the midpoint of a radius connecting the face plane 125 and the sole portion 108. The clubhead includes a clubhead front-to-back depth, $D_{CH}$, which is the distance between two points projected onto the ground plane 111. A forward end 118 of the clubhead is defined as the intersection of the projection of the leading edge 142 onto the ground plane 111. A rearward end 119 of the clubhead is defined as the intersection of the projection of the rearward-most point of the clubhead (as viewed in the y-z plane) onto the ground plane 111. The distance between the forward end 118 and rearward end 119 of the clubhead is the clubhead depth $D_{CH}$.

In certain embodiments of iron type golf club heads having hollow construction, such as the embodiment shown in FIG. 1C, a recess 134 is located above the rear protrusion 138 in the back portion 128 of the club head. A back wall 132 encloses the entire back portion 128 of the club head to define an interior cavity 120. The interior cavity 120 may be completely or partially hollow, or it optionally may be filled with a filler material. In the embodiment shown in FIG. 1C, the interior cavity 120 includes a vibration dampening plug 121 that is retained between the rear surface 110*b* of the striking face and the inner surface 132*b* of the back wall. Suitable filler materials and details relating to the nature and materials comprising the plug 121 are described in US Patent Application Publication No. 2011/0028240, which is incorporated herein by reference.

FIG. 1C further shows an optional ridge 136 extending across a portion of the outer back wall surface 132*a* forming an upper concavity and a lower concavity. An inner back wall surface 132*b* defines a portion of the cavity 120 and forms a thickness between the outer back wall surface 132*a* and the inner back wall surface 132*b*. In some embodiments, the back wall thickness varies between a thickness of about 0.5 mm to about 4 mm. A sole bar 135 is located in a low, rearward portion of the clubhead 100. The sole bar 135 has a relatively large thickness in relation to the striking plate and other portions of the clubhead 100, thereby accounting for a significant portion of the mass of the clubhead 100, and thereby shifting the center of gravity (CG) of the clubhead 100 relatively lower and rearward. A channel 150—described more fully below—is formed in the sole bar 135. Furthermore, the sole portion 108 has a forward portion 144 that is located immediately rearward of the striking face 110. In the embodiment shown in FIG. 1C, the forward portion 144 of the sole is a relatively thin-walled section of the sole that extends within a region between the channel 150 and the striking face 110.

FIG. 1D further shows a sole bar 135 of the cavity back golf club head 100. The sole bar 135 has a relatively large thickness in relation to the striking plate and other portions of the golf club head 100, thereby accounting for a significant portion of the mass of the golf club head 100, and thereby shifting the center of gravity (CG) of the golf club head 100 relatively lower and rearward. The embodiment shown in FIG. 1D also includes a forward portion 144 of the sole that has a reduced sole thickness and that extends within between the sole bar 135 and the striking face 110. A channel 150—described more fully below—is located in a forward region of the sole bar 135.

FIG. 1E shows another embodiment of a hollow iron clubhead 100 having a channel 150. As with the embodiment shown in FIG. 1C, the clubhead 100 includes a striking face 110, a top line 106, a sole 108, and a back wall 132. The sole includes a sole bar 135 having a channel 150 defined by a forward wall 152 and rear wall 154. A forward portion 144 of the sole is located between the striking face 110 and the forward wall 152 of the slot. The hollow clubhead 100 includes an aperture 133 that is suitable for installing a vibration dampening plug 121 like that shown in FIG. 1C, and which is described in more detail in US Patent Application Publication No. 2011/0028240, which is incorporated by reference. Installation of the vibration dampening plug 121 effectively seals the aperture 133.

In some embodiments, the volume of the hollow iron clubhead 100 may be between about 10 cubic centimeters (cc) and about 120 cc. For example, in some embodiments, the hollow iron clubhead 100 may have a volume between about 20 cc and about 110 cc, such as between about 30 cc and about 100 cc, such as between about 40 cc and about 90 cc, such as between about 50 cc and about 80 cc, such as between about 60 cc and about 80 cc. In addition, in some embodiments, the hollow iron clubhead 100 has a clubhead depth, $D_{CH}$, that is between about 15 mm and about 100 mm. For example, in some embodiments, the hollow iron clubhead 100 may have a clubhead depth, $D_{CH}$, of between about 20 mm and about 90 mm, such as between about 30 mm and about 80 mm, such as between about 40 mm and about 70 mm.

In certain embodiments of the golf club head 100 that include a separate striking plate attached to the body 113 of the golf club head, the striking plate can be formed of forged maraging steel, maraging stainless steel, or precipitation-hardened (PH) stainless steel. In general, maraging steels have high strength, toughness, and malleability. Being low in carbon, they derive their strength from precipitation of inter-metallic substances other than carbon. The principle alloying element is nickel (15% to nearly 30%). Other alloying elements producing inter-metallic precipitates in these steels include cobalt, molybdenum, and titanium. In one embodiment, the maraging steel contains 18% nickel. Maraging stainless steels have less nickel than maraging steels but include significant chromium to inhibit rust. The chromium augments hardenability despite the reduced nickel content, which ensures the steel can transform to martensite when appropriately heat-treated. In another embodiment, a maraging stainless steel C455 is utilized as the striking plate. In other embodiments, the striking plate is a precipitation hardened stainless steel such as 17-4, 15-5, or 17-7.

The striking plate can be forged by hot press forging using any of the described materials in a progressive series of dies. After forging, the striking plate is subjected to heat-treatment. For example, 17-4 PH stainless steel forgings are heat treated by 1040° C. for 90 minutes and then solution quenched. In another example, C455 or C450 stainless steel forgings are solution heat-treated at 830° C. for 90 minutes and then quenched.

In some embodiments, the body 113 of the golf club head is made from 17-4 steel. However another material such as carbon steel (e.g., 1020, 1030, 8620, or 1040 carbon steel), chrome-molybdenum steel (e.g., 4140 Cr—Mo steel), Ni—Cr—Mo steel (e.g., 8620 Ni—Cr—Mo steel), austenitic stainless steel (e.g., 304, N50, or N60 stainless steel (e.g., 410 stainless steel) can be used.

In addition to those noted above, some examples of metals and metal alloys that can be used to form the components of the parts described include, without limitation: titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

In still other embodiments, the body 113 and/or striking plate of the golf club head are made from fiber-reinforced polymeric composite materials, and are not required to be homogeneous. Examples of composite materials and golf club components comprising composite materials are described in U.S. Patent Application Publication No. 2011/0275451, which is incorporated herein by reference in its entirety.

The body 113 of the golf club head can include various features such as weighting elements, cartridges, and/or inserts or applied bodies as used for CG placement, vibration control or damping, or acoustic control or damping. For example, U.S. Pat. No. 6,811,496, incorporated herein by reference in its entirety, discloses the attachment of mass altering pins or cartridge weighting elements.

After forming the striking plate and the body 113 of the golf club head, the striking plate and body portion 113 contact surfaces can be finish-machined to ensure a good interface contact surface is provided prior to welding. In some embodiments, the contact surfaces are planar for ease of finish machining and engagement.

2. Iron Type Golf Club Heads Having a Flexible Boundary Structure

In some embodiments of the iron type golf club heads described herein, a flexible boundary structure ("FBS") is provided at one or more locations on the club head. The flexible boundary structure may comprise, in several embodiments, a slot, a channel, a gap, a thinned or weakened region, or other structure that enhances the capability of an adjacent or related portion of the golf club head to flex or deflect and to thereby provide a desired improvement in the performance of the golf club head. For example, in several embodiments, the flexible boundary structure is located proximate the striking face of the golf club head in order to enhance the deflection of the striking face upon impact with a golf ball during a golf swing. The enhanced deflection of the striking face may result, for example, in an increase in the coefficient of restitution ("COW") of the golf club head. In other embodiments, the increased perimeter flexibility of the striking face may cause the striking face to deflect in a different location and/or different manner in comparison to the deflection that occurs upon striking a golf ball in the absence of the channel, slot, or other flexible boundary structure.

Figure 2A:
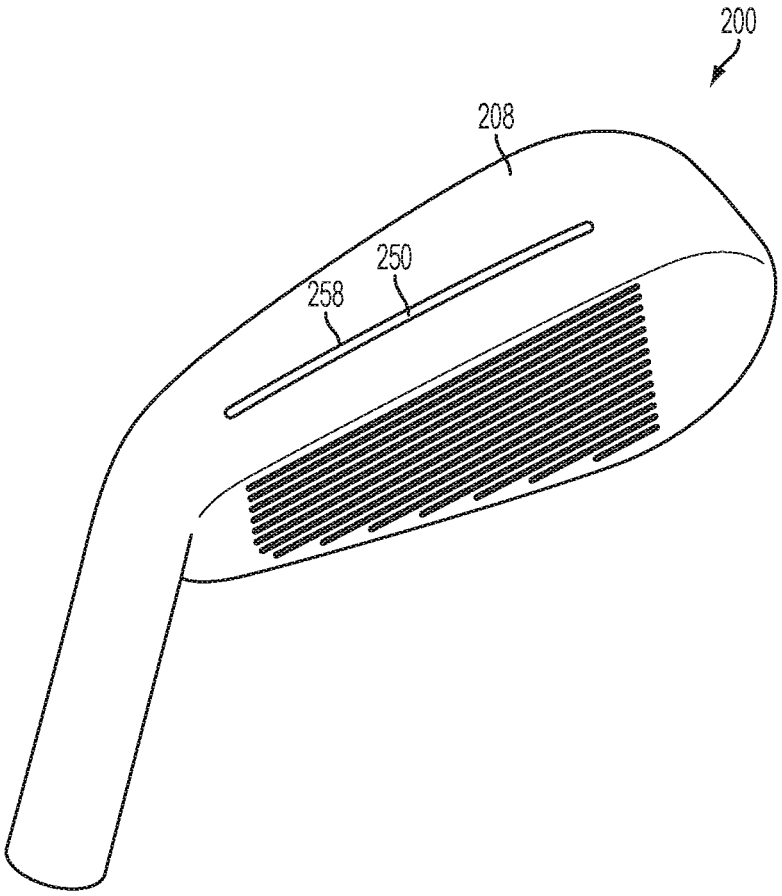
FIG. 2A is a bottom perspective view of an embodiment of a golf club head.
Figure 2B:
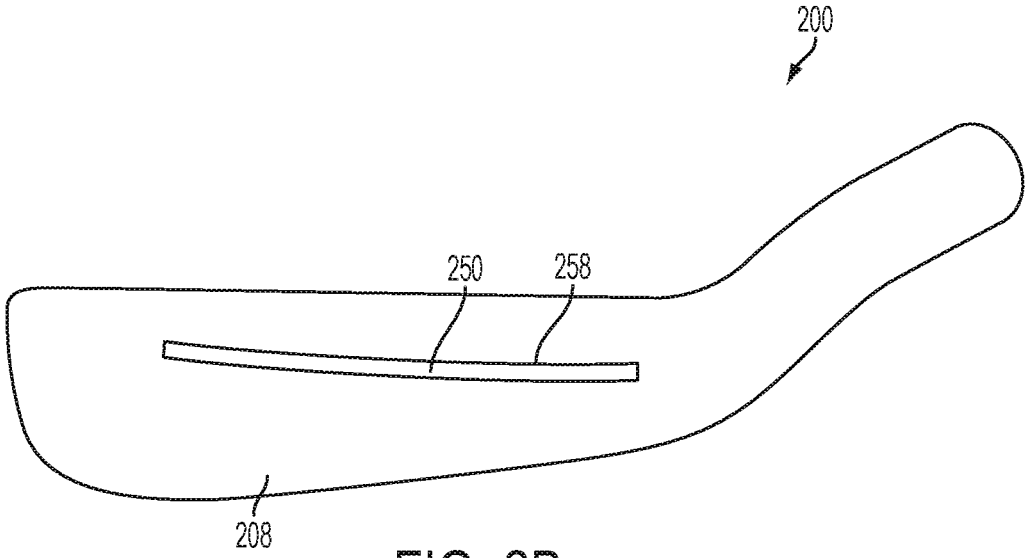
FIG. 2B is a bottom view of the sole of the golf club head shown in FIG. 2A.
Figure 2C:
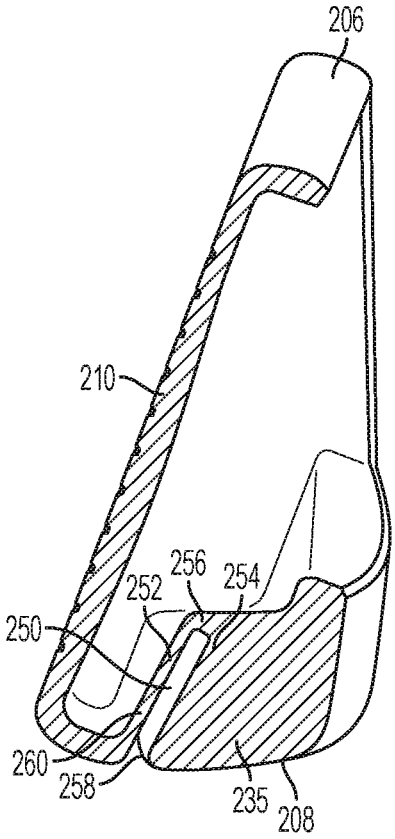
FIG. 2C is a cross-sectional view of the golf club head shown in FIG. 2A.

Turning to FIGS. 2A-2C, an embodiment of a cavity back golf club head 200 having a flexible boundary structure is shown. In the embodiment, the flexible boundary structure is a channel 250 that is located on the sole of the club head. It should be noted that, as described above, the flexible boundary structure may comprise a slot, a channel, a gap, a thinned or weakened region, or other structure. For clarity, however, the descriptions herein will be limited to embodiments containing a channel, such as the channel 250 illustrated in FIGS. 2A-C, or a slot, included in several embodiments described below, with it being understood that other flexible boundary structures may be used to achieve the benefits described herein.

The channel 250 extends over a region of the sole 208 generally parallel to and spaced rearwardly from the striking face plane 225. The channel extends into and is defined by a forward portion of the sole bar 235, defining a forward wall 252, a rear wall 254, and an upper wall 256. A channel opening 258 is defined on the sole portion 208 of the club head. The forward wall 252 further defines, in part, a first hinge region 260 located at the transition from the forward portion of the sole 244 to the forward wall 252, and a second hinge region 262 located at a transition from the upper region of the forward wall 252 to the sole bar 235. The first hinge region 260 and second hinge region 262 are portions of the golf club head that contribute to the increased deflection of the striking face 210 of the golf club head due to the presence of the channel 250. In particular, the shape, size, and orientation of the first hinge region 260 and second hinge region 262 are designed to allow these regions of the golf club head to flex under the load of a golf ball impact. The flexing of the first hinge region 260 and second hinge region 262, in turn, creates additional deflection of the striking face 210.

Several aspects of the size, shape, and orientation of the club head 200 and channel 250 are illustrated in the embodiment shown in FIGS. 2A-H. For example, for each cross-section of the clubhead defined within the y-z plane, the face to channel distance D1 is the distance measured on the ground plane 211 between a face plane projection point 226 and a channel centerline projection point 227. (See FIG. 2F). The face plane projection point 226 is defined as the intersection of a projection of the striking face plane 225 onto the ground plane 211. The channel centerline projection point 227 is defined as the intersection of a projection of a channel centerline 229 onto the ground plane 211. The channel centerline 229 is determined according to the following.

Figure 2D:
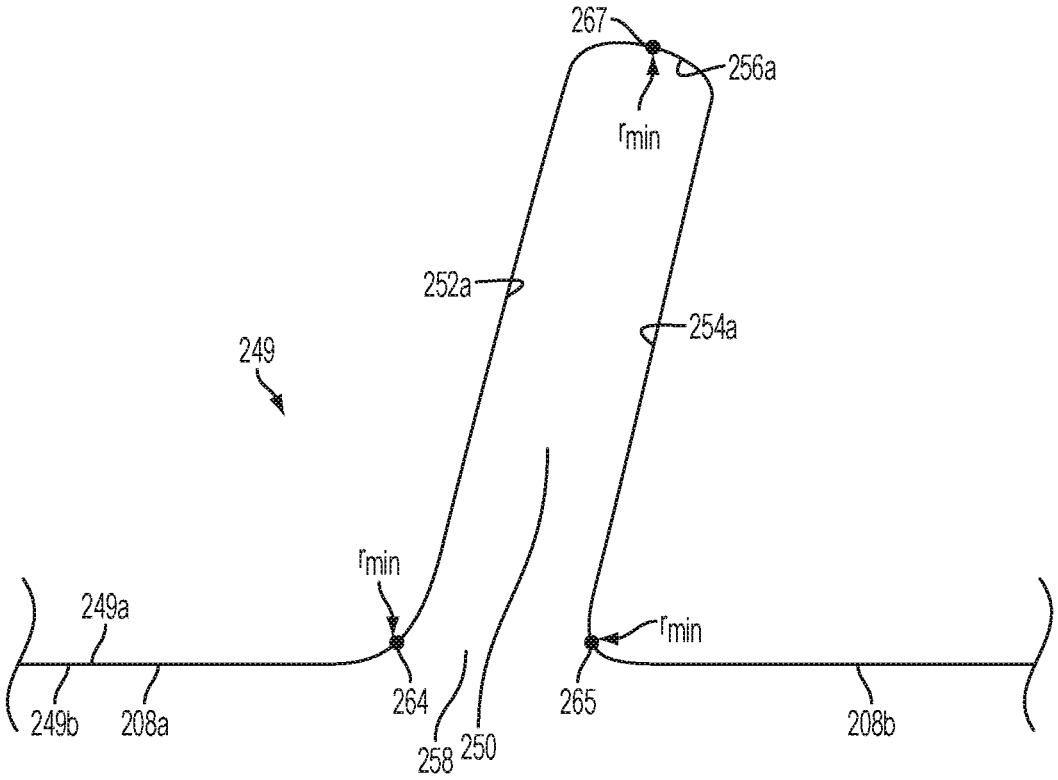
FIGS. 2D-E are schematic representations of a profile of the outer surface of a portion of a club head that surrounds and includes the region of a channel.
Figure 2E:
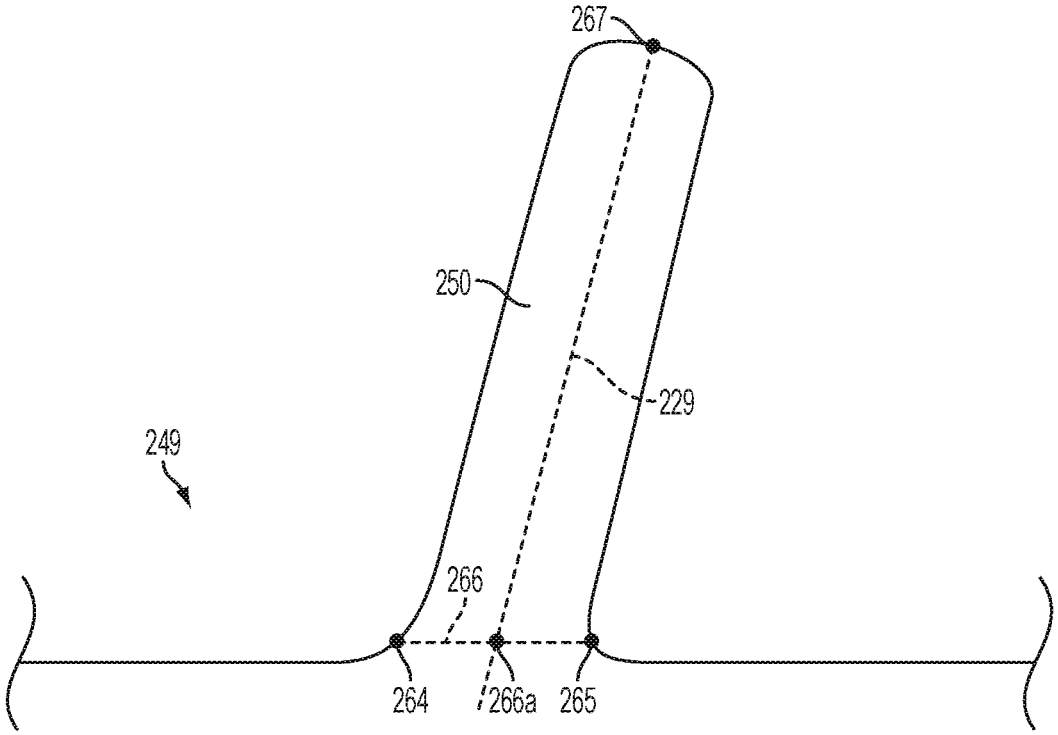
Figure 2F:
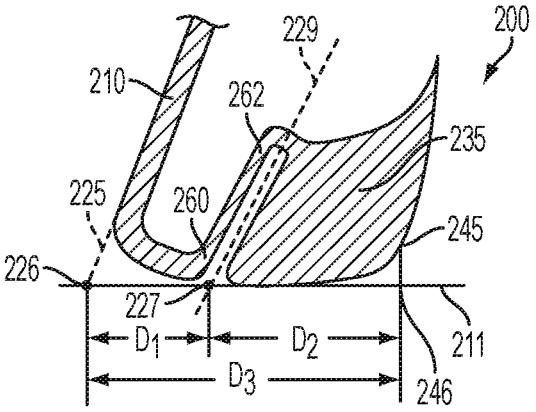
FIGS. 2F-H are cross-sectional views of a channel region of an embodiment of a golf club head.
Figure 2G:
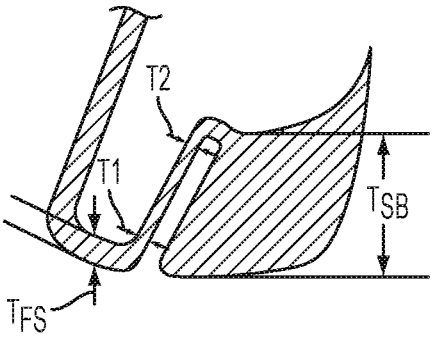
Figure 2H:
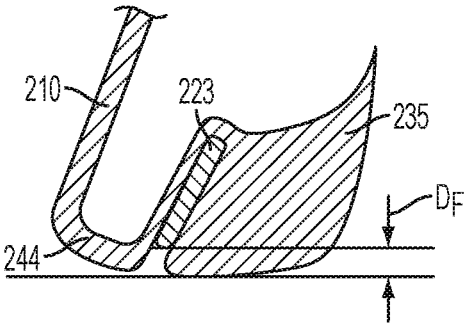

Referring to FIGS. 2D-E, a schematic profile 249 of the outer surface of a portion of the clubhead 200 that surrounds and includes the region of the channel 250 is shown. The schematic profile has an interior side 249*a* and an exterior side 249*b*. A forward sole exterior surface 208*a* extends on a forward side of the channel 250, and a rearward sole exterior surface 208*b* extends on a rearward side of the channel 250. The channel has a forward wall exterior surface 252*a*, a rear wall exterior surface 254*a*, and an upper wall exterior surface 256*a*. A forward channel entry point 264 is defined as the midpoint of a curve having a local minimum radius ($r_{min}$, measured from the interior side 249*a* of the schematic profile 249) that is located between the forward sole exterior surface 208*a* and the forward wall exterior surface 252*a*. A rear channel entry point 265 is defined as the midpoint of a curve having a local minimum radius ($r_{min}$, also measured from the interior side 249*a* of the schematic profile 249) that is located between the rearward sole exterior surface 208*b* and the rear wall exterior surface 254*a*. An imaginary line 266 that connects the forward channel entry point 264 and the rear channel entry point 265 defines the channel opening 258. A midpoint 266*a* of the imaginary line 266 is one of two points that define the channel centerline 229. The other point defining the channel centerline 229 is an upper channel peak 267, which is defined as the midpoint of a curve having a local minimum radius ($r_{min}$, as measured from the exterior side 249*b* of the schematic profile 249) that is located between the forward wall exterior surface 252*a* and the rear wall exterior surface 254*a*. In an embodiment having one or more flat segment(s) or flat surface(s) located at the upper end of the channel between the forward wall 252 and rear wall 254, the upper channel peak 267 is defined as the midpoint of the flat segment(s) or flat surface(s).

Another aspect of the size, shape, and orientation of the club head 200 and channel 250 is the sole width. For example, for each cross-section of the clubhead defined within the y-z plane, the sole width, D3, is the distance measured on the ground plane 211 between the face plane projection point 226 and a trailing edge projection point 246. (See FIG. 2F). The face plane projection point 226 is defined above. The trailing edge projection point 246 is the intersection with the ground plane 211 of an imaginary vertical line passing through the trailing edge 245 of the clubhead 200. The trailing edge 245 is defined as a midpoint of a radius or a point that constitutes a transition from the sole portion 208 to the back wall 232 or other structure on the back portion 228 of the clubhead.

Still another aspect of the size, shape, and orientation of the club head 200 and channel 250 is the channel to rear distance, D2. For example, for each cross-section of the clubhead defined within the y-z plane, the channel to rear distance D2 is the distance measured on the ground plane 211 between the channel centerline projection point 227 and a vertical projection of the trailing edge 245 onto the ground plane 211. (See FIG. 2F). As a result, for each such cross-section, D1+D2=D3.

Figure 3A:
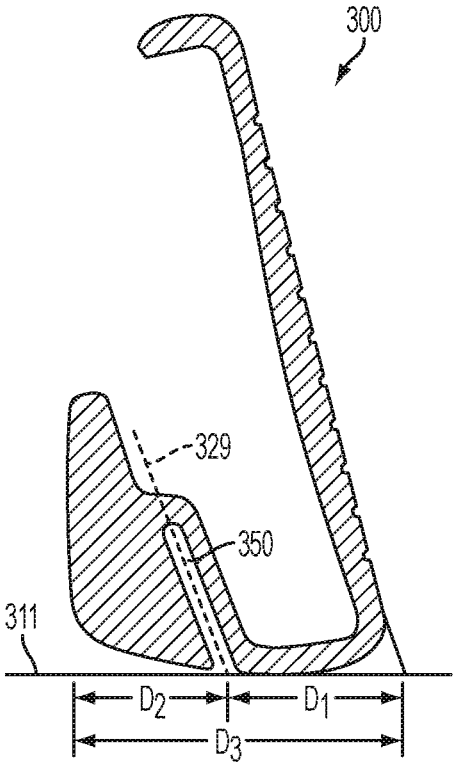
FIGS. 3A-3B, 4A-4B, and 5A-5B, are cross-sectional views of exemplary golf club heads.
Figure 3B:
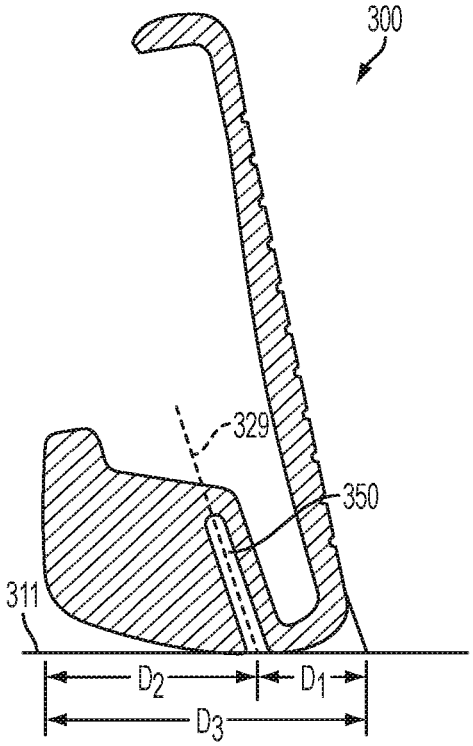

FIGS. 3A-B illustrate two embodiments of golf club heads 300 having a channel 350 that operates as a flexible boundary structure. The two embodiments are similarly designed with the exception of the face to channel distance D1 of each embodiment, as measured at a cross-section taken at the ideal striking location 301. The club head embodiment shown in FIG. 3A includes a face to channel distance D1 that is substantially larger than the face to channel distance D1 of the embodiment shown in FIG. 3B while the sole width D3 (as measured at the same cross-section taken at the ideal striking location 301) of each of the embodiments is the same.

Table 1 below lists several exemplary values for the face to channel distance D1, channel to rear distance D2, sole width D3, and the ratios of D1/D3, D2/D3, and D1/D2 for several examples of clubheads that include a channel 350 according to the embodiments described herein. The measurements reported in Table 1 are for the average face to channel distance (D1), average channel to rear distance (D2), and average sole width (D3) over a portion of the clubhead extending 25 mm to each side (i.e., toe side and heel side) of the ideal striking location 301. As used herein, the terms "average face to channel distance (D1)," "average channel to rear distance (D2)," and "average sole width (D3)" refer to an average of a plurality of D1, D2, or D3 measurements, with the plurality of D1, D2, or D3 measurements being taken within a plurality of imaginary parallel vertical planes that include a first vertical plane passing through the ideal striking location 301 and that contains a vector drawn normal to the striking face 310 at the ideal striking location 301, and a plurality of additional vertical planes that are parallel to the first vertical plane and that are spaced at regular 1 mm increments on each side of the ideal striking location 301.

TABLE 1

| | Loft | D1 (mm) | D2 (mm) | D3 (mm) | D1/D3 | D2/D3 | D1/D2 |
|---|---|---|---|---|---|---|---|
| Ex. 1 | 20-21° | 3.5-17 | 11-24 | 15-28 | 0.13-0.61 | 0.39-0.86 | 0.15-0.71 |
| | | 5.5-14 | 13-22 | 16-27 | 0.20-0.52 | 0.48-0.81 | 0.25-0.64 |
| | | 8-11 | 15-18 | 17-26 | 0.31-0.42 | 0.58-0.69 | 0.44-0.61 |
| Ex. 2 | 26-28° | 3.5-17 | 11-24 | 15-28 | 0.13-0.61 | 0.39-0.86 | 0.15-0.71 |
| | | 5.5-14 | 13-22 | 16-27 | 0.20-0.52 | 0.48-0.81 | 0.25-0.64 |
| | | 8-11 | 15-18 | 17-26 | 0.32-0.43 | 0.58-0.69 | 0.44-0.61 |

Returning to FIGS. 2A-C, additional aspects of the design of the club head 200 and channel 250 include the channel width W1, channel length L1, and channel depth H1. The channel width W1 is a measure of the distance in a horizontal plane (i.e., a plane that is parallel to the ground plane 211) between the forward wall 252 and rear wall 254 of the channel at a given cross-section of the channel 250. The channel length L1 is generally a measure of the distance on the sole 208 of the club head between the toeward-most point of the channel and the heelward-most point of the channel, without taking into account any curvature of the channel 250. The channel depth H1 is generally a measure of the distance from the ground plane 211 to the highest point (in the y-z plane) of the inner surface of the channel on the channel upper wall 256 when the clubhead 200 is resting on the ground plane 211. As shown in FIGS. 2A-C, in some embodiments, the channel 250 includes a constant width W1 and constant depth H1 over its full length. In other embodiments, one or more of these three parameters may be varied to achieve desired design and/or performance objectives.

Figure 4A:
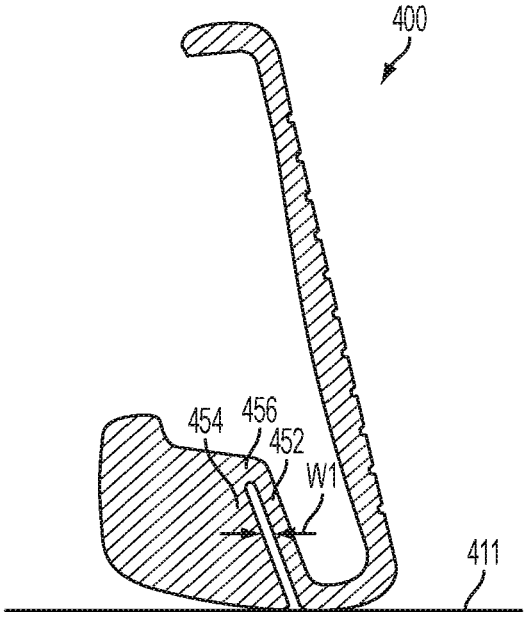
Figure 4B:
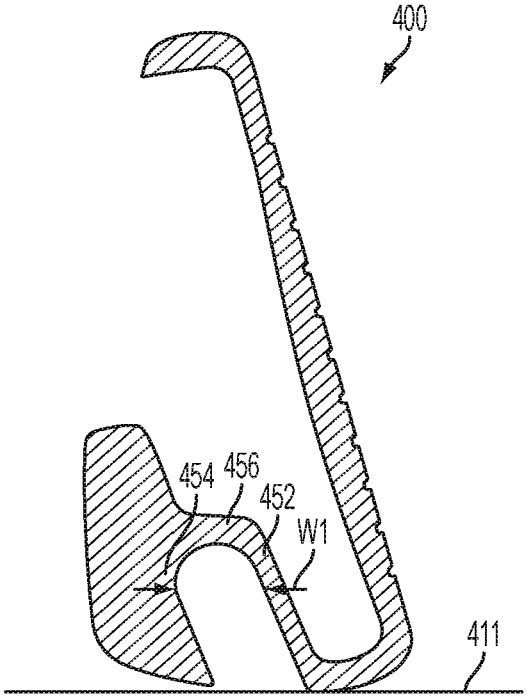

FIGS. 4A-B illustrate two embodiments of golf club heads 400 having a channel 450 that operates as a flexible boundary structure. The two embodiments are similarly designed with the exception of the channel width W1 of each embodiment. The club head embodiment shown in FIG. 4A includes a channel width W1 that is constant, and that is substantially smaller than the (also constant) channel width W1 of the embodiment shown in FIG. 4B. In other embodiments, a channel may have a width W1 that is not constant. In those embodiments, an average channel width W1 may be determined. As used herein, the term "average channel width W1" refers to an average of a plurality of W1 measurements, with the plurality of W1 measurements being taken within a plurality of imaginary parallel horizontal planes that include a first horizontal plane passing through a point that is located at a distance equal to one-half of the channel height H1 above the ground plane 411, and a plurality of additional horizontal planes that are parallel to the first horizontal plane and that are spaced at regular 0.5 mm increments above and below the first horizontal plane. The uppermost imaginary parallel horizontal plane is located at a height that is 80% of the channel height H1 above the ground plane 411, and the lowermost imaginary parallel horizontal plane is located at a height that is at least 20% of the channel height H1 above the ground plane 411. All of the imaginary parallel horizontal planes must include a point located on the forward wall 452 of the channel and the rear wall 454 of the channel. In some embodiments of the club heads described herein, the average channel width W1 may be from about 0.50 mm to about 10.0 mm, such as from about 1.0 mm to about 4.0 mm, such as from about 1.25 mm to about 2.5 mm. In one embodiment, the average channel width W1 is about 1.75 mm.

In some embodiments, the channel width W1 at the channel opening 258 is sufficiently wide that the forward wall 252 and rear wall 254 of the channel do not contact one another when, for example, a golf ball is struck by the clubhead 200, but the channel width W1 at the channel opening 258 is sufficiently narrow that the amount of dirt, grass, and other materials entering the channel 250 may be reduced relative to a channel having a wider channel opening 258. For example, in some embodiments, the channel width W1 at the channel opening 258 may be from about 0.5 mm to about 5 mm, such as from about 1.0 mm to about 4 mm, such as from about 1.25 mm to about 3 mm.

Figure 5A:
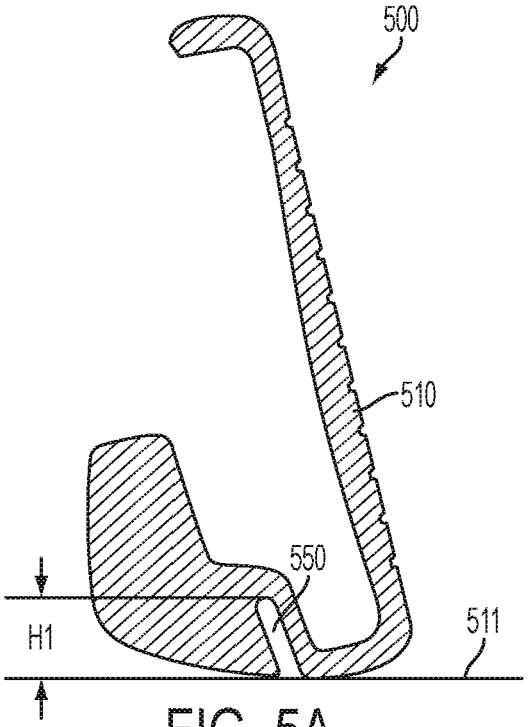
Figure 5B:
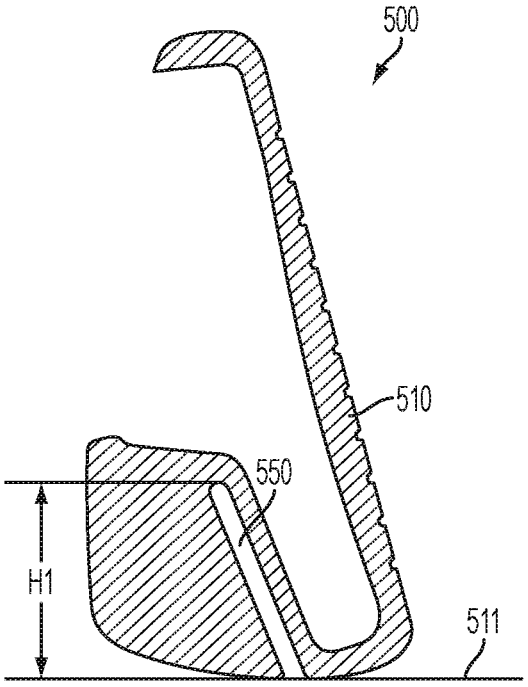

FIGS. 5A-B illustrate two embodiments of golf club heads 500 having a channel 550 that operates as a flexible boundary structure. The two embodiments are similarly designed with the exception of the channel depth H1 of each embodiment. The club head embodiment shown in FIG. 5A includes a constant channel depth H1 that is substantially smaller than the (also constant) channel depth H1 of the embodiment shown in FIG. 5B. In other embodiments, a channel may have a depth H1 that is not constant. In those embodiments, a maximum channel depth $H1_{MAX}$ and an average channel depth $H1_{AVG}$ may be determined. As used herein, the term "maximum channel depth $H1_{MAX}$" refers to a maximum value for the channel depth H1 occurring over the full length of the channel. As used herein, the term "average channel depth $H1_{AVG}$" refers to an average of H1 measurements, with the plurality of H1 measurements being taken within a plurality of imaginary parallel vertical planes that include a first vertical plane passing through the ideal striking location 501 and that contains a vector drawn normal to the striking face 510 at the ideal striking location 501, and a plurality of additional vertical planes that are parallel to the first vertical plane and that are spaced at regular 1 mm increments on each side of the ideal striking location 501.

Table 2 below lists several exemplary values for the average channel depth $H1_{AVG}$, maximum channel depth $H1_{MAX}$, club head height $H_{CH}$, and the ratios of $H1_{AVG}/H_{CH}$ and $H1_{MAX}/H_{CH}$ for several examples of clubheads that include a channel according to the embodiments described herein.

TABLE 2

| | Loft | $H1_{AVG}$ (mm) | $H1_{MAX}$ (mm) | $H_{CH}$ (mm) | $H1_{AVG}/H_{CH}$ | $H1_{MAX}/H_{CH}$ |
|---|---|---|---|---|---|---|
| Ex. 1 | 20-21° | 5.0-25.0 | 5.0-45 | 25-75 | 0.07-0.50 | 0.07-0.70 |
| | (4I) | 6.0-14.5 | 6.0-30 | 35-65 | 0.10-0.41 | 0.10-0.60 |
| | | 8.5-13.0 | 8.5-23 | 40-60 | 0.14-0.33 | 0.14-0.50 |
| Ex. 2 | 26-28° | 5.0-25.0 | 5.0-45 | 25-75 | 0.07-0.50 | 0.07-0.70 |
| | (6I) | 6.0-14.5 | 6.0-30 | 35-65 | 0.10-0.41 | 0.10-0.60 |
| | | 8.5-13.0 | 8.5-23 | 40-60 | 0.14-0.33 | 0.14-0.50 |

Figure 6A:
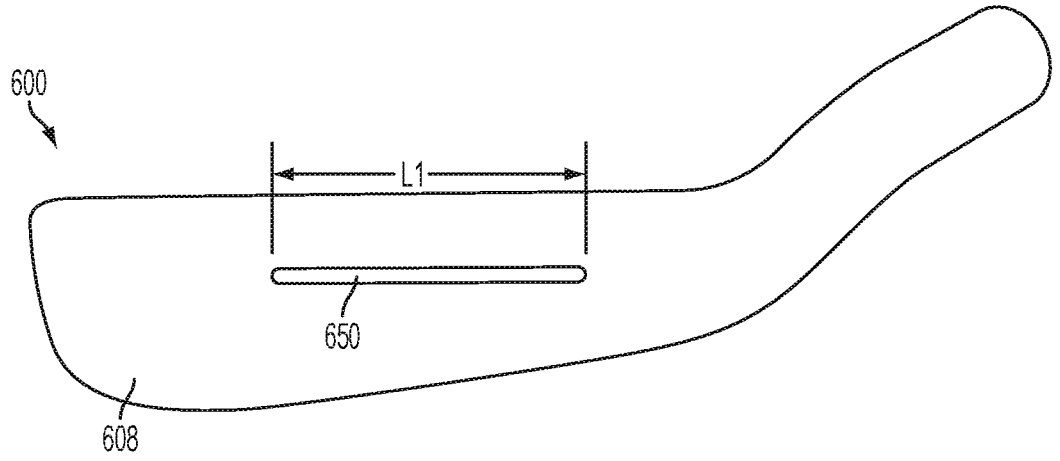
FIGS. 6A-B are bottom views of the soles of exemplary golf club heads.
Figure 6B:
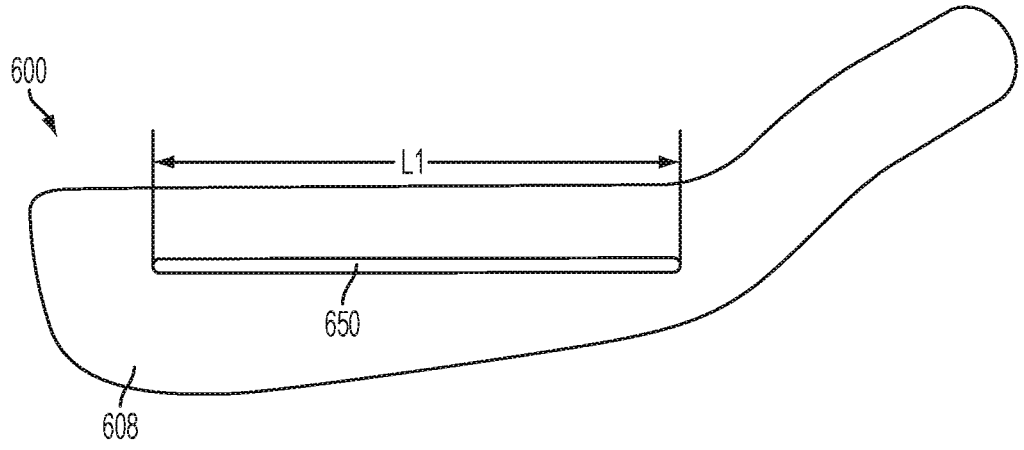

FIGS. 6A-B illustrate two embodiments of golf club heads 600 having a channel 650 that operates as a flexible boundary structure. The two embodiments are similarly designed with the exception of the channel length L1 of each embodiment. The club head embodiment shown in FIG. 6A includes a channel length L1 that is substantially shorter than the channel length L1 of the embodiment shown in FIG. 6B. In some embodiments of the club heads described herein, the channel length L1 may be from about 15 mm to about 62 mm, such as from about 40 mm to about 57 mm, such as from about 45 mm to about 55 mm. In one embodiment, the channel length L1 is about 50 mm.

Table 3 below lists several exemplary values for the channel length L1, sole length $L_B$, and the ratio of $L1/L_B$ for several examples of clubheads that include a channel according to the embodiments described herein.

TABLE 3

| | Loft | L1 (mm) | $L_B$ (mm) | $L1/L_B$ |
|---|---|---|---|---|
| Ex. 1 | 20-21° | 15-85 mm | 65-90 mm | 0.17-1.0 |
| | (4I) | 30-57 mm | 70-85 mm | 0.35-0.67 |
| | | 45-55 mm | 75-82 mm | 0.55-0.65 |
| Ex. 2 | 26-28° | 15-62 mm | 65-90 mm | 0.17-1.0 |
| | (6I) | 30-57 mm | 70-85 mm | 0.35-0.67 |
| | | 45-55 mm | 75-82 mm | 0.55-0.65 |

Table 4 below lists several exemplary values for the channel length L1, the average channel depth $H1_{AVG}$, the maximum channel depth $H1_{MAX}$, and the ratios of $H1_{AVG}/L1$ and $H1_{MAX}/L1$ for several examples of clubheads that include a channel according to the embodiments described herein.

TABLE 4

| | Loft | $H1_{AVG}$ (mm) | $H1_{MAX}$ (mm) | L1 (mm) | $H1_{AVG}/L1$ | $H1_{MAX}/L1$ |
|---|---|---|---|---|---|---|
| Ex. 1 | 20-21° | 5.0-25.0 | 5.0-45 | 15-85 mm | 0.06-0.50 | 0.06-0.65 |
| | (4I) | 6.0-14.5 | 6.0-30 | 30-57 mm | 0.11-0.40 | 0.11-0.50 |
| | | 8.5-13.0 | 8.5-23 | 45-55 mm | 0.18-0.30 | 0.18-0.40 |
| Ex. 2 | 26-28° | 5.0-25.0 | 5.0-45 | 15-62 mm | 0.06-0.50 | 0.06-0.65 |
| | (6I) | 6.0-14.5 | 6.0-30 | 30-57 mm | 0.11-0.40 | 0.11-0.50 |
| | | 8.5-13.0 | 8.5-23 | 45-55 mm | 0.18-0.30 | 0.18-0.40 |

Returning to FIGS. 2A-H, and specifically to FIG. 2G, still other aspects of the design of the club head 200 and channel 250 include the wall and component thicknesses of at least the following three portions of the club head. A first wall thickness, T1, is a measure of the thickness of the first hinge region 260. A second wall thickness, T2, is a measure of the thickness of the second hinge region 262. A forward sole wall minimum thickness, $T_{FS}$, is a measure of the minimum thickness (measured in a vertical plane) of the forward portion 244 of the sole, i.e., the portion of the sole 208 located between the striking face 210 and the channel 250. A sole bar maximum thickness $T_{SB}$ is a measure of the maximum thickness (measured in a vertical plane) of the portion of the sole bar 235 located rearward of the channel 250. As shown in FIGS. 2A-C, in some embodiments, the club head 200 includes a first hinge region 260, second hinge region 262, and forward portion 244 of the sole that each have a constant thickness over their full lengths. In other embodiments, one or more of these parameters may be varied to achieve desired design and/or performance objectives.

Figure 7A:
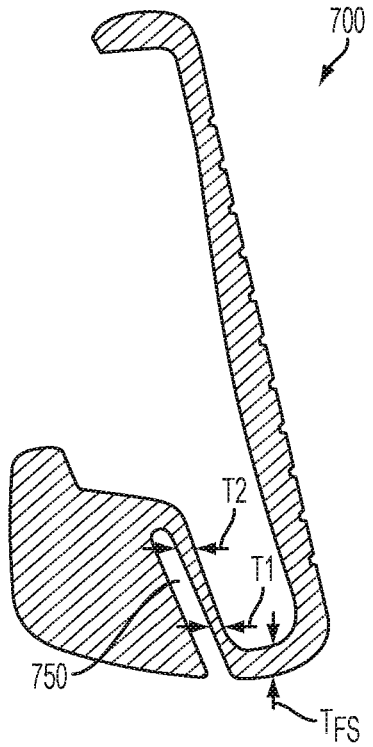
FIGS. 7A-7B, 8A-8B, and 9 are cross-sectional views of exemplary golf club heads.
Figure 7B:
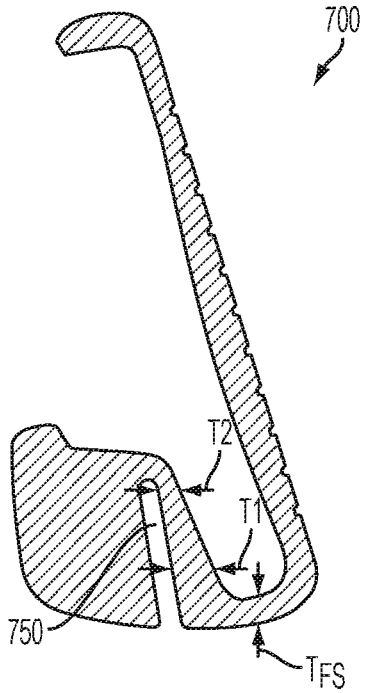

FIGS. 7A-B illustrate two embodiments of golf club heads 700 having a channel 750 that operates as a flexible boundary structure. The two embodiments are similarly designed with the exception of the orientation of the channel 750 and the resultant variation in the thickness, T1, of the first hinge region of each embodiment. The club head embodiment shown in FIG. 7A includes a first hinge region thickness T1 that is substantially smaller/thinner than the first hinge region thickness T1 of the embodiment shown in FIG. 7B. In some embodiments of the club heads described herein, the first hinge region thickness T1 may be from about 0.5 mm to about 5.0 mm, such as from about 1.0 mm to about 3.0 mm, such as from about 1.2 mm to about 2.0 mm. In one embodiment, the first hinge region thickness T1 is about 1.5 mm.

Figure 8A:
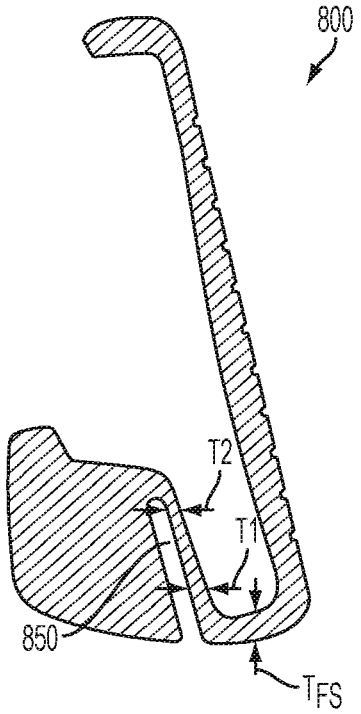
Figure 8B:
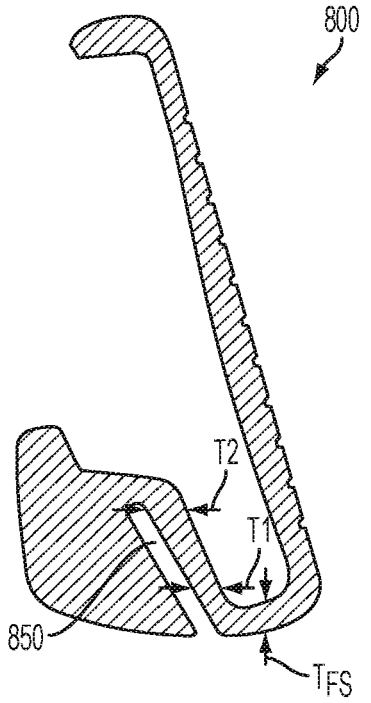

FIGS. 8A-B illustrate two embodiments of golf club heads 800 having a channel 850 that operates as a flexible boundary structure. The two embodiments are similarly designed with the exception of the orientation of the channel 850 and the resultant variation in the thickness, T2, of the second hinge region of each embodiment. The club head embodiment shown in FIG. 8A includes a second hinge region thickness T2 that is substantially smaller/thinner than the second hinge region thickness T2 of the embodiment shown in FIG. 8B. In some embodiments of the club heads described herein, the second hinge region thickness T2 may be from about 0.5 mm to about 5.0 mm, such as from about 1.0 mm to about 2.5 mm, such as from about 1.2 mm to about 2.0 mm. In one embodiment, the second hinge region thickness T2 is about 1.5 mm.

Table 5 below lists several exemplary values for the forward sole minimum thickness $T_{FS}$, sole bar maximum thickness $T_{SB}$, and the ratio of $T_{FS}/T_{SB}$ for several examples of clubheads that include a channel according to the embodiments described herein.

TABLE 5

| | Loft | $T_{FS}$ (mm) | $T_{SB}$ (mm) | $T_{FS}/T_{SB}$ |
|---|---|---|---|---|
| Ex. 1 | 20-21° | 0.5-5.0 | 4.0-40 | 0.04-0.50 |
| | (4I) | 0.8-3.0 | 5.0-30 | 0.05-0.40 |
| | | 1.0-2.5 | 7.0-25 | 0.06-0.35 |
| Ex. 2 | 26-28° | 0.5-5.0 | 4.0-40 | 0.04-0.50 |
| | (6I) | 0.8-3.0 | 5.0-30 | 0.05-0.40 |
| | | 1.0-2.5 | 7.0-25 | 0.06-0.35 |

Figure 9:
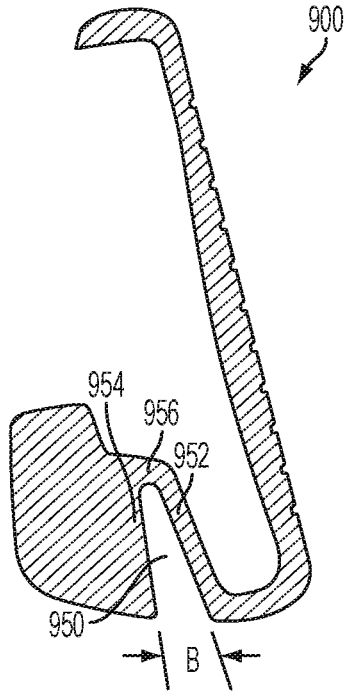

Returning again to FIGS. 2A-C, the channel 250 shown in the illustrated embodiment includes a forward channel wall 252 that is generally parallel to the striking face 210, and that is also generally parallel to the rear channel wall 254. As a result, the channel width W1 is substantially constant over the depth of the channel. In an alternative embodiment, shown in FIG. 9, a club head 900 includes a channel 950 having a forward channel wall 952, rear channel wall 954, and upper channel wall 956. The forward channel wall 952 and rear channel wall 954 are not parallel to one another, defining an included angle β that may be from slightly greater than 0° to about 25° or more.

3. Channel/Slot Profile Shapes and Orientations

In each of the embodiments described above, the channel is defined by forward, rear, and upper walls, and has a channel opening that is formed on the sole portion of the club head. Accordingly, except for the channel opening, each of the channels described above is closed at its forward, rear, and upper ends. In alternative embodiments, instead of a closed channel, a channel may be provided having one or more openings that extend through one or more of the channel walls, and/or a slot having no upper wall extends fully through the sole portion (or other portion) of the club head in which it is located.

For example, in the embodiments shown in FIGS. 17A-B and 18A-C, a cavity back iron golf club head 1700 includes a channel 1750 that is defined in part by a forward wall 1752, rear wall 1754, and upper wall 1756. The club head also includes a top line 1706, a striking face 1710, a forward portion of the sole 1744, and a sole bar 1735, as described in relation to the embodiments described above. Moreover, in alternative embodiments (not shown in FIGS. 17A-B and 18A-C), the club head 1700 may comprise a hollow iron (see, e.g., FIGS. 1C and 1E).

One or more cutouts or windows 1794 are provided on the forward wall 1752 of the channel. See, e.g., FIGS. 18A-B. Each window 1794 provides increased flexibility to the forward channel wall 1752, thereby increasing the capability of the flexible boundary structure (FBS) provided by the channel 1750 to flex or deflect and to thereby provide a desired improvement in the performance of the golf club head. In the embodiments shown, the forward wall 1752 includes three cutouts or windows 1794 that are generally equally spaced along the heel-to-toe length of the forward wall 1752. In alternative embodiments, fewer (e.g., one or two) or more (e.g., four or more) cutouts or windows 1794 may be provided.

Figure 18A:
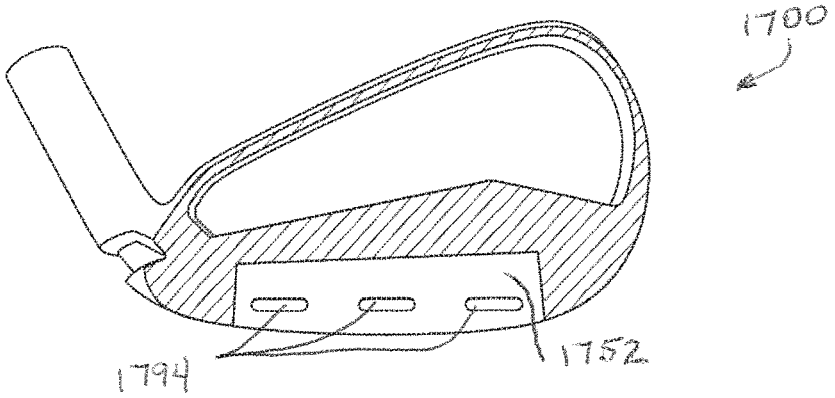
FIGS. 18A-B are cross-sectional views of two embodiments of golf club heads taken along section line 18-18 in FIG. 17B.
Figure 18B:
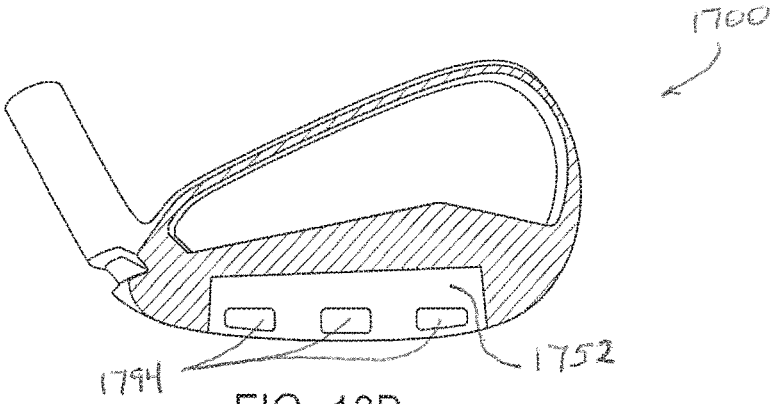
Figure 18C:
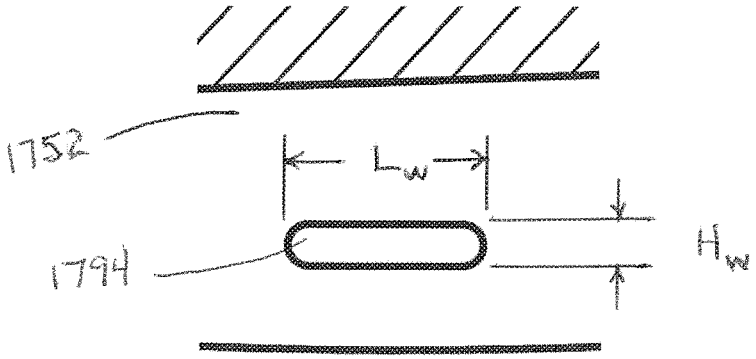
FIG. 18C is a close-up view of a cutout or window of the golf club head shown in FIG. 18A.

Although the example windows 1794 have an oblong shape, other shapes (e.g., round, oval, elliptical, triangular, square, rectangular, trapezoidal, etc.) are also possible. Turning to FIG. 18C, in the example shown, a representative cutout or window 1794 has a length $L_w$ which corresponds to the distance between the toeward-most and heelward-most ends of the window 1794, and a height $H_w$ that corresponds to the distance between the crownward-most and soleward-most ends of the window 1794. The length $L_w$ may be from about 1 mm to as much as the length L1 of the channel 1750, such as up to about 85 mm (e.g., in an embodiment that includes only a single window 1794). In the embodiments shown in FIGS. 18A-B, in which the forward wall includes three windows 1794, the windows each have a length $L_w$ of from about 3 mm to about 18 mm, such as from about 6 mm to about 15 mm, such as from about 8 mm to about 12 mm. The height $H_w$ may be from about 0.5 mm to as much as the height H1 of the channel 1750, such as up to about 25 mm. In the embodiments shown in FIGS. 18A-B, the windows each have a height $H_w$ of from about 0.5 mm to about 15 mm, such as from about 1 mm to about 12 mm, such as from about 1.5 mm to about 8 mm.

Although not shown in the drawings, in alternative embodiments, one or more windows or cutouts may be formed through the channel rear wall 1754 and extending through the sole bar 1735, with an exit port provided on a rearward-facing surface of the club head.

Figure 10A:
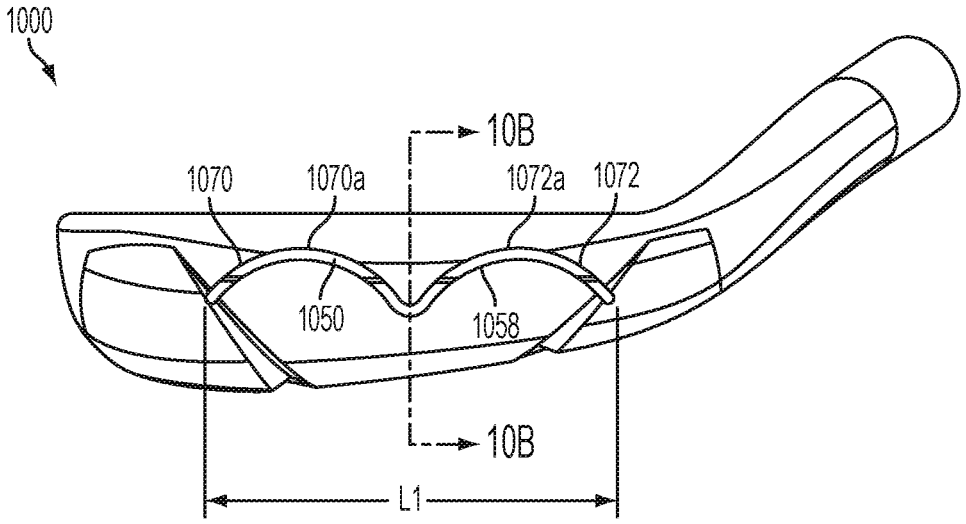
FIG. 10A is a bottom view of the sole of and exemplary golf club head.
Figure 10B:
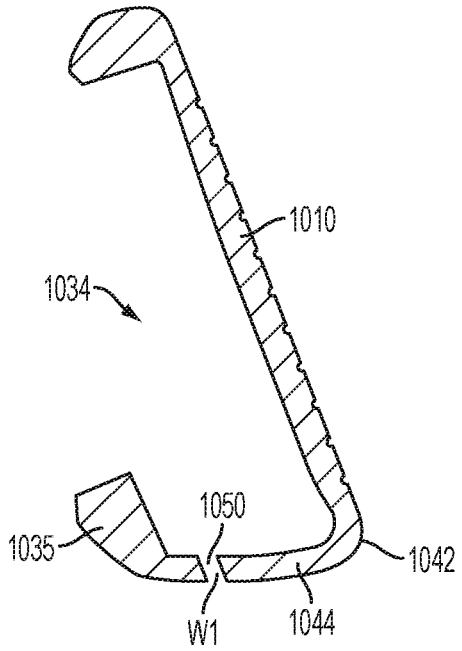
FIG. 10B is a cross-sectional view of the golf club head shown in FIG. 10A.

Turning to FIGS. 10A-B, in another example, a cavity back iron club head 1000 includes a slot 1050 that extends fully through the sole 1008 into the recess 1034 at the back portion of the club head. In an alternative embodiment (not shown in FIGS. 10A-B), a hollow iron (see, e.g., FIG. 1C) may include a slot that extends fully through the sole and into the interior cavity of the club head.

The embodiment shown in FIG. 10A also shows a slot 1050 with an opening 1058 that has a non-straight, curved shape when viewing the sole of the club head. In other embodiments, the slot 1050 may be straight or may have a curved shape that is different from the embodiment shown in FIG. 10A, several of which are described below. In the example shown, the slot opening 1058 is continuous and includes a first curved region 1070 and a second curved region 1072. Each of the first and second curved regions 1070, 1072 defines a generally semi-circular shape. The first curved region 1070 has a peak 1070*a* that represents a point at which the first curved region 1070 is nearest to the leading edge 1042, and that is located on the toeward half of the club head 1000. The second curved region 1072 has a peak 1072*a* that represents a point at which the second curved region 1072 is nearest to the leading edge 1042, and that is located on the heelward half of the club head 1000. A center connecting region 1073 connects the first and second curved regions 1070, 1072, and is typically centered at or near the 0 coordinate of the CG x-axis 105.

The slot 1050 is located rearward of the forward portion 1044 of the sole and forward of the sole bar 1035. The slot 1050 has a face to slot distance, D1, that is variable over the length of the slot 1050 due to the curvature of the first curved region 1070 and second curved region 1072. In the embodiment shown in FIGS. 10A-B, the face to slot distance may be comparable to the ranges for the face to channel distance D1 of the embodiments described above in relation to FIGS. 2A-H and FIGS. 3A-B. The slot 1050 also has a slot length, L1, that may be comparable to the ranges for the channel lengths L1 of the embodiments described above in relation to FIGS. 2A-H and FIGS. 6A-B. The slot 1050 also has a slot width, W1, that may be comparable to the ranges for the channel widths W1 of the embodiments described above in relation to FIGS. 2A-H and FIGS. 4A-B. In addition, in the embodiment shown, the forward portion 1044 of the sole may have a forward sole wall minimum thickness, $T_{FS}$, that may be comparable to the ranges for the forward sole wall minimum thickness $T_{FS}$ of the embodiments described above in relation to FIGS. 2A-H and FIGS. 8A-B.

In some alternative embodiments (not shown in the drawings), an iron club head 1000 may include a slot 1050 that extends fully through the sole 1008, and the forward portion 1044 of the sole may have a forward sole wall minimum thickness, $T_{FS}$, that is larger than the ranges for the forward sole wall minimum thickness $T_{FS}$ of the embodiments described above in relation to FIGS. 2A-H and FIGS. 8A-B. For example, in these alternative embodiments, the forward sole wall minimum thickness, $T_{FS}$, may be from about 5 mm to about 15 mm, such as from about 5 mm to about 12 mm, such as from about 5 mm to about 8 mm.

Turning next to FIGS. 19A-B and 20A-B, examples are shown of a cavity back iron golf club head 1900 having a sole slot 1950. The club head also includes a top line 1906, a striking face 1910, a forward portion of the sole 1944, and a sole bar 1935, as described in relation to the embodiments described above. The slot 1950 defines a passage through the sole 1908 into the recess 1934 at the back portion of the club head 1900. Moreover, in alternative embodiments (not shown in FIGS. 19A-B and 20A-B), the club head 1900 may comprise a hollow iron (see, e.g., FIGS. 1C and 1E), in which case the slot 1950 provides a passage through the sole 1908 into the internal cavity 120 of the club head. The term "rear void" as used herein shall refer to either or both of a recess 1934 of a cavity back iron golf club head or an internal cavity 120 of a hollow golf club head. In certain embodiments the recess 1934 may contain a badge, which may be adhesively attached to the rear surface of the face, or may be attached to another portion of the club head to form a portion of, or all of, the back wall 132. In certain cavity back embodiments the badge is adhesively attached to the rear surface of the face and extends over a portion of the sole bar or thickened rearward sole bar and conceal the filler material. The badge may contain an aperture through which the filler material is inserted, or the badge may cover an opening used to insert the filler material.

The slot 1950 is located in the sole 1908, rearward of the forward portion 1944 of the sole and forward of the sole bar 1935. The slot 1950 has a face to slot distance, D1, that may be comparable to the ranges for the face to channel distance D1 of the embodiments described above in relation to FIGS. 2A-H and FIGS. 3A-B. The slot 1950 also has a slot length, L1, that may be comparable to the ranges for the channel lengths L1 of the embodiments described above in relation to FIGS. 2A-H and FIGS. 6A-B. The slot 1950 also has a slot width, W1, that may be comparable to the ranges for the channel widths W1 of the embodiments described above in relation to FIGS. 2A-H and FIGS. 4A-B. In addition, in the embodiment shown, the forward portion 1944 of the sole may have a forward sole wall minimum thickness, $T_{FS}$, that may be comparable to the ranges for the forward sole wall minimum thickness $T_{FS}$ of the embodiments described above in relation to FIGS. 2A-H and FIGS. 8A-B.

Cross-sectional views of the club head show a profile of the shape of the slot 1950 at a central region of the club head. As shown, for example, in FIGS. 19A-B and 20A-B, the sole bar 1935 includes an overhang member 1996 that extends into the space above the mouth of the slot 1950. In the FIG. 19A-B embodiment, the overhang member 1996 extends over a substantial portion of the height of the forward-facing portion of the sole bar 1935, whereas in the FIG. 20A-B embodiment, the overhang member 1996 comprises a narrow ledge extending from the forward-facing portion of the sole bar 1935 above the mouth of the slot 1950. In some embodiments, the location and weight of the overhang member 1996 may provide a desirable forward shift of the CG relative to a club head that does not include the overhang member 1996. In other embodiments, the overhang member 1996 may provide a backstop that serves to partially trap or retain a viscous filler material that is injected or otherwise inserted into the slot 1950 during manufacture of the club head, as described in more detail below.

The overhang member 1996 and slot 1950 define a non-linear passage through the sole 1908 and into the rear void of the club head, such as into the recess 1934 at the back portion of the club head 1900 (for a cavity back iron club head), or through the sole 1908 into the internal cavity 120 of the club head (for a hollow iron club head). The non-linear passage may be defined by the axial path 1998 illustrated in FIGS. 19B and 20B. The axial path 1998 represents an imaginary line comprising a summation of the midpoints of lines representing the shortest distances between all points on the internal surfaces of the forward sole portion 1944 and rear surface of the striking plate 1910 on a forward side of the club head and opposed points on the internal surfaces of the sole bar 1935 (including the overhang member 1996) on a rearward side of the club head, for a given cross-section such as that shown in FIGS. 19B and 20B.

Figure 19A:
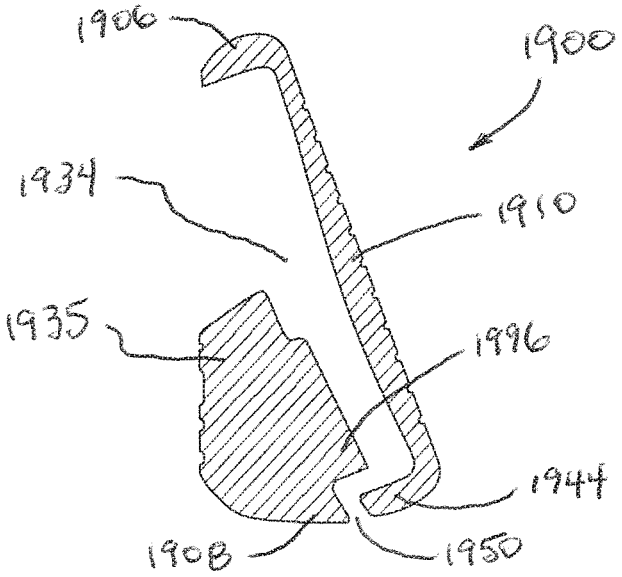
FIG. 19A is a cross-sectional view of another embodiment of a golf club head.
Figure 19B:
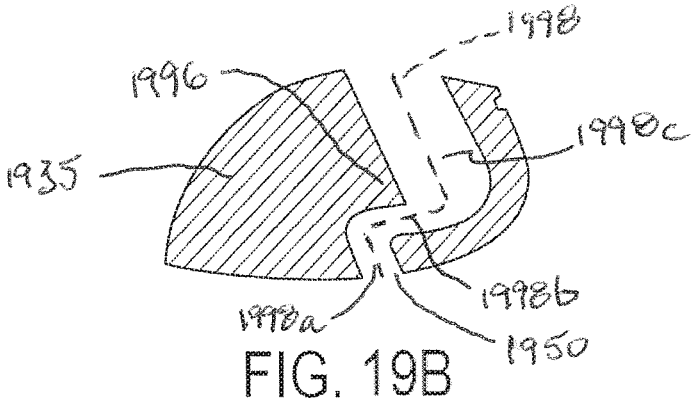
FIG. 19B is a close-up cross-sectional view of a portion of the golf club head shown in FIG. 19A.
Figure 20A:
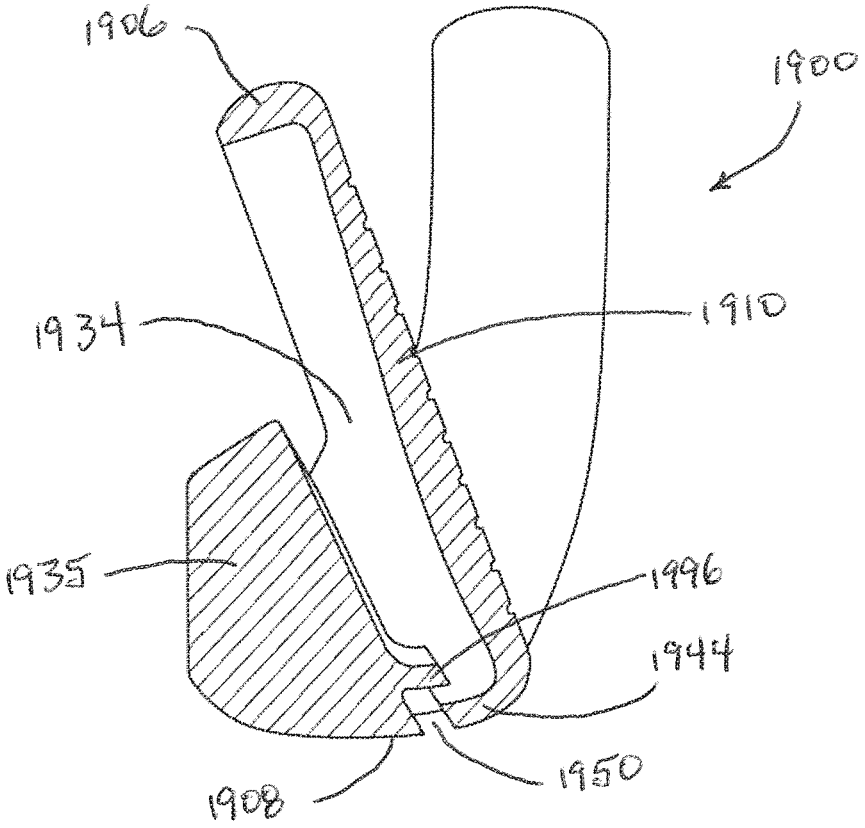
FIG. 20A is a cross-sectional view of another embodiment of a golf club head.
Figure 20B:
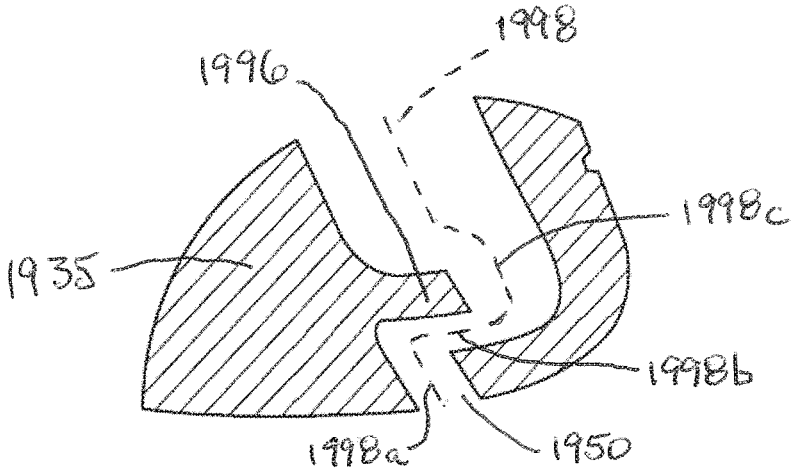
FIG. 20B is a close-up cross-sectional view of a portion of the golf club head shown in FIG. 20A.

In the embodiments shown in FIGS. 19B and 20B, the non-linear axial path 1998 includes at least a lower path region 1998*a* passing through the mouth of the slot 1950, the lower path region 1998*a* having an axial direction that is generally parallel to the face plane 125, an intermediate path region 1998*b* that is axially directed generally perpendicular to the face plane 125, and an upper path region 1998*c* that is axially directed generally parallel to the face plane 125. For example, in some embodiments, the lower path region 1998*a* includes a portion having a length of at least about 1 mm that is within about 30° of being parallel to the face plane 125, such as within about 20° of being parallel to the face plane 125, such as within about 15° of being parallel to the face plane 125. In some embodiments, the intermediate path region 1998*b* includes a portion having a length of at least about 1 mm that is within about 30° of being perpendicular to the face plane 125, such as within about 20° of being perpendicular to the face plane 125, such as within about 15° of being perpendicular to the face plane 125. In some embodiments, the upper path region 1998*c* includes a portion having a length of at least about 1 mm that is within about 30° of being parallel to the face plane 125, such as within about 20° of being parallel to the face plane 125, such as within about 15° of being parallel to the face plane 125.

Turning next to FIGS. 11A-H, several examples of sole channel or sole slot profiles are shown. In each example, a club head 1100 includes a slot 1150 that extends over a portion of the sole 1108 of the club head. In the embodiment shown in FIG. 11A, the slot 1150 is a straight slot having an orientation, shape, and size that is comparable to the channel profile examples described above in relation to FIGS. 2A-C. In the embodiment shown in FIG. 11B, the slot 1150 has a shape of a single continuous curve 1174 having a toe side end 1174*a*, a heel side end 1174*b*, and a single peak 1174*c* that is generally located at a point corresponding with the 0 coordinate of the CG x-axis 105 and/or corresponding with the CG x-axis coordinate of the ideal impact location 101 (see FIG. 1A). Similarly, in the embodiment shown in FIG. 11C, the slot 1150 has a shape of a single continuous curve 1174 having a toe side end 1174*a*, a heel side end 1174*b*, and a single peak 1174*c* that is generally located at a point corresponding with the 0 coordinate of the CG x-axis 105 and/or corresponding with the CG x-axis coordinate of the ideal impact location 101 (see FIG. 1A). In the FIG. 11B embodiment, the single peak 1174*a* is arched toward the front portion 1130 of the club head, i.e., the distance of the single peak 1174*a* to the nearest portion of the leading edge 1142 is less than the distance of each of the toe side and heel side ends 1174*a*, 1174*b* to the nearest portions of the leading edge 1142. In the FIG. 11C embodiment, the single peak 1174*a* is arched toward the back portion 1128 of the club head, i.e., the distance of the single peak 1174*a* to nearest portion of the leading edge 1142 is greater than the distance of each of the toe side and heel side ends 1174*a*, 1174*b* to the nearest portions of the leading edge 1142.

Figure 11A:
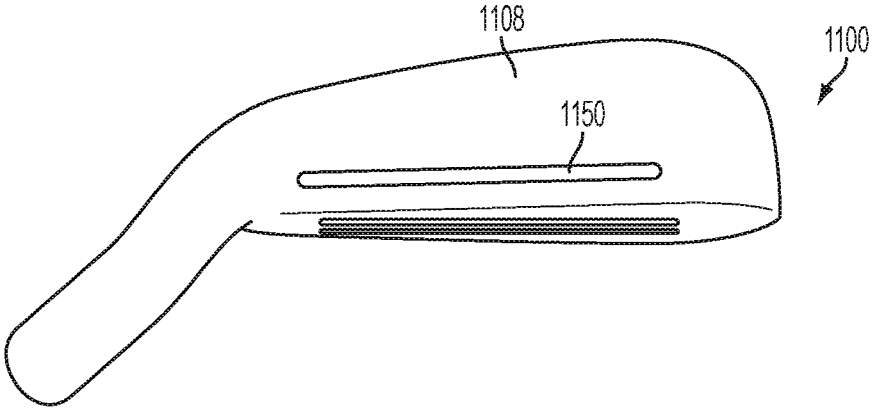
FIGS. 11A-J are bottom views of the soles of exemplary golf club heads.
Figure 11B:
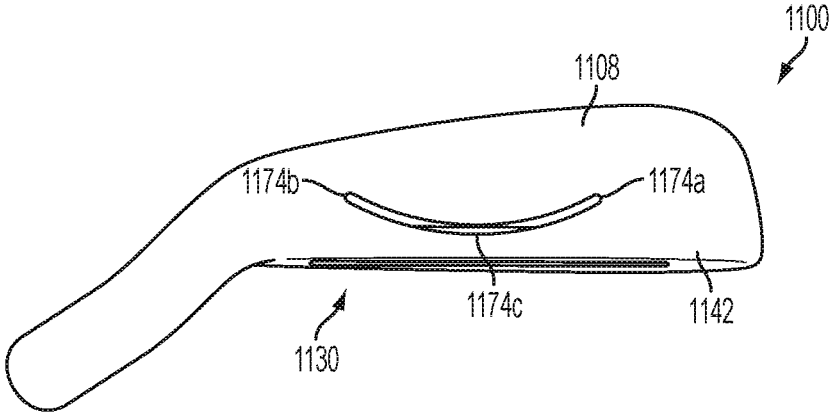
Figure 11C:
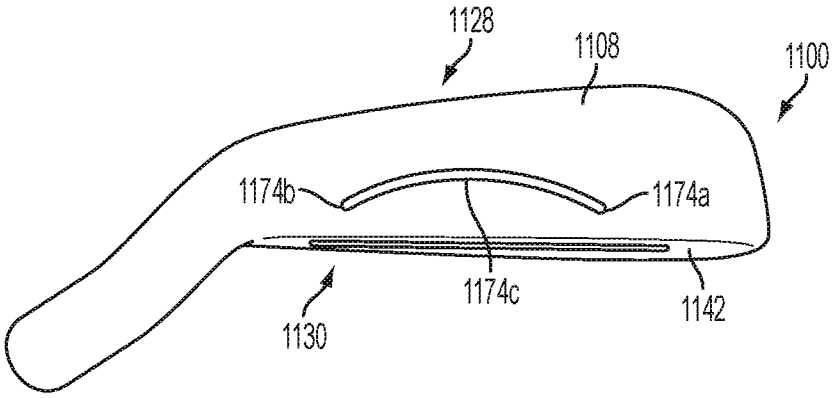
Figure 11D:
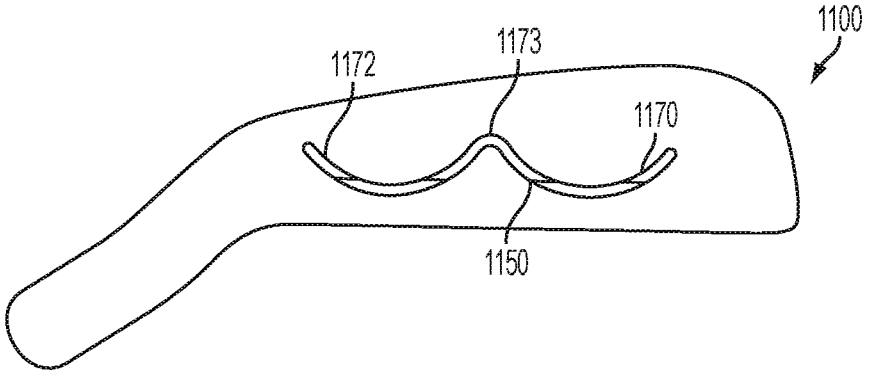
Figure 11E:
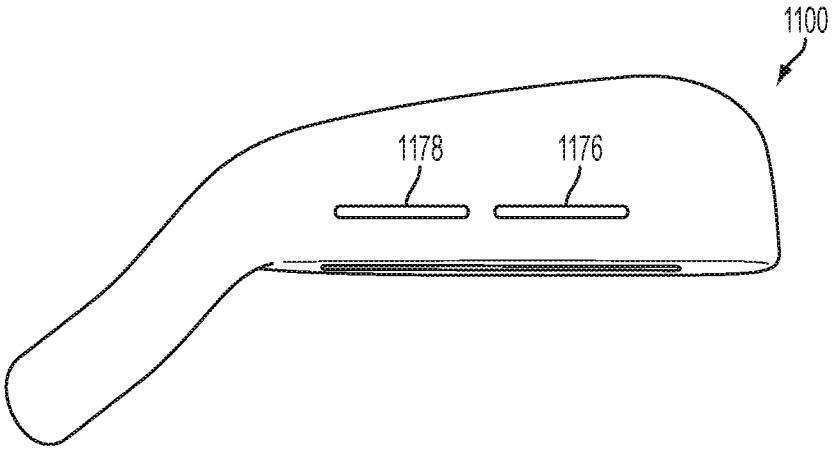
Figure 11F:
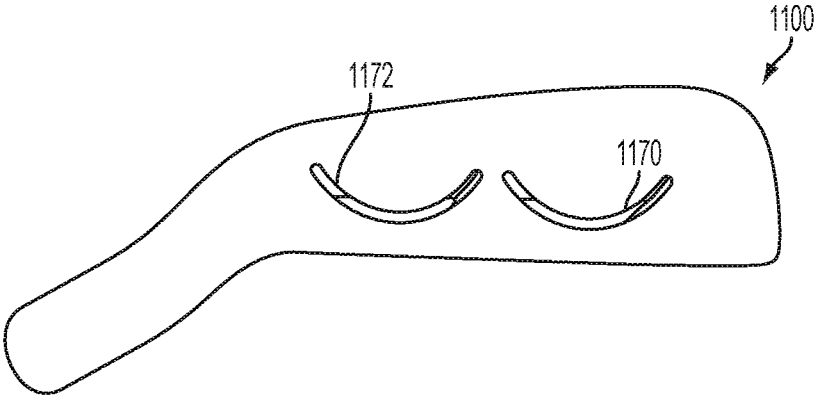

In the embodiment shown in FIG. 11D, the slot 1150 is a continuous curved slot having an orientation, shape, and size that is comparable to the examples described above in relation to FIGS. 10A-B, including a first curved region 1170, a second curved region 1172, and a center connecting region 1173. The club head embodiment shown in FIG. 11F includes a slot 1150 having a first curved region 1170 and a second curved region 1172, but the slot does not include a center connection region. Instead, the slot 1150 shown in FIG. 11F is non-continuous, having two separate sections—the first curved region 1170 and second curved region 1172. Finally, the club head embodiment shown in FIG. 11E includes a slot 1150 that is also non-continuous, comprising a first straight region 1176 and a second straight region 1178 that are separate and not connected to each other.

Figure 11G:
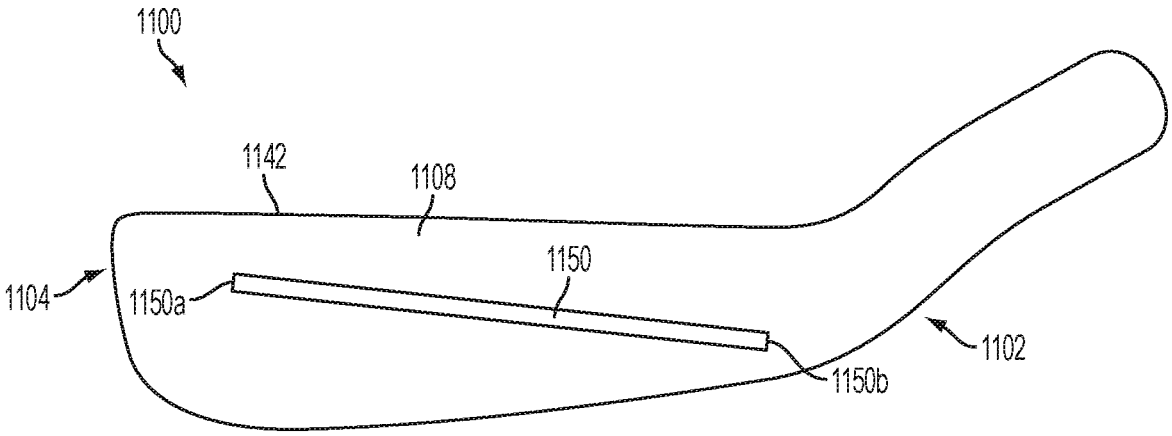

In the embodiment shown in FIG. 11G, a club head 1100 includes a single, continuous, straight slot 1150 that extends over a substantial portion of the length of the sole 1108, extending generally from the heel portion 1102 to the toe portion 1104. The slot 1150 has a skewed or non-parallel orientation relative to the leading edge 1142. In the embodiment shown, the distance from the toe side end 1150*a* of the slot to the leading edge 1142 is less than the distance from the heel side end 1150*b* of the slot to the leading edge 1142.

Figure 11H:
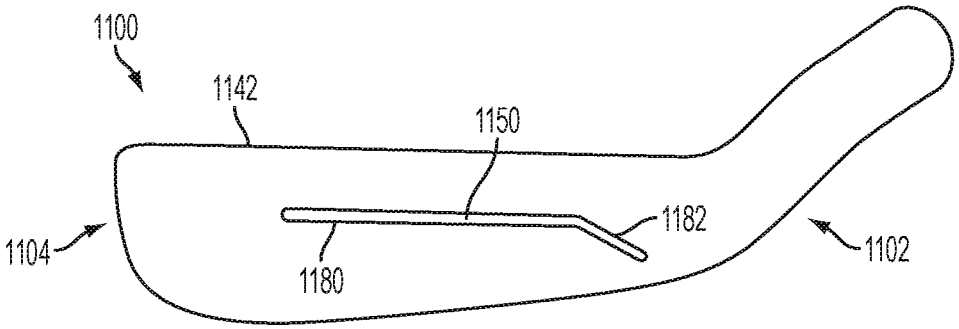

In the embodiment shown in FIG. 11H, a club head 1100 includes a single, continuous slot 1150 that includes a main portion 1180 that is substantially parallel with the leading edge 1142 of the club head, and a secondary portion 1182 near the heel region 1102 that is oriented at an angle away from the leading edge 1142.

Figure 11I:
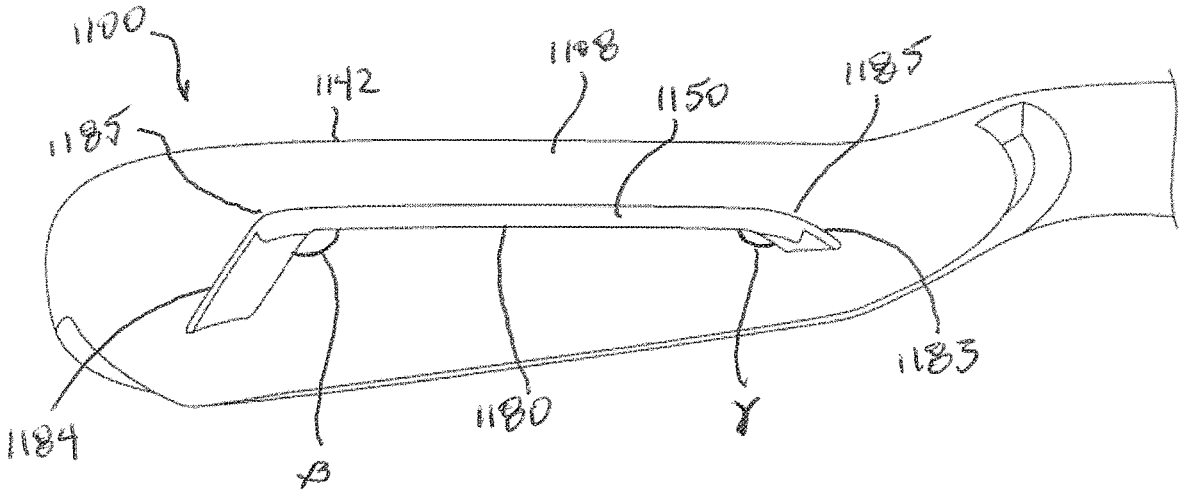

Similarly, in FIG. 11I, a club head 1100 includes a single, continuous slot 1150 that includes a main portion 1180 that is substantially parallel with the leading edge 1142 of the club head, a heel relief portion 1183 and a toe relief portion 1184. In the embodiment shown, each of the heel relief portion 1183 and toe relief portion 1184 is joined with the main portion 1180 of the slot by a radius region 1185 that provides a transition from the leading edge parallel alignment of the main portion 1180 to the rearwardly-directed alignment of the heel relief portion 1183 and toe relief portion 1184. As shown, the heel relief portion 1183 is aligned generally rearward from the main portion 1180, defining a relief angle γ which may be from about 90° to about 150°. Similarly, the toe relief portion 1184 is aligned generally rearward from the main portion 1180, defining a relief angle β which may be from about 90° to about 150°. In some embodiments, the relief angles γ and β are equal or substantially the same, while in other embodiments the relief angles γ and β are different. In some embodiments, the slot width W1 of one or both of the heel relief portion 1183 and/or the toe relief portion 1184 may be larger than the slot width W1 of the main portion 1180, as shown for example in FIG. 11I.

Figure 11J:
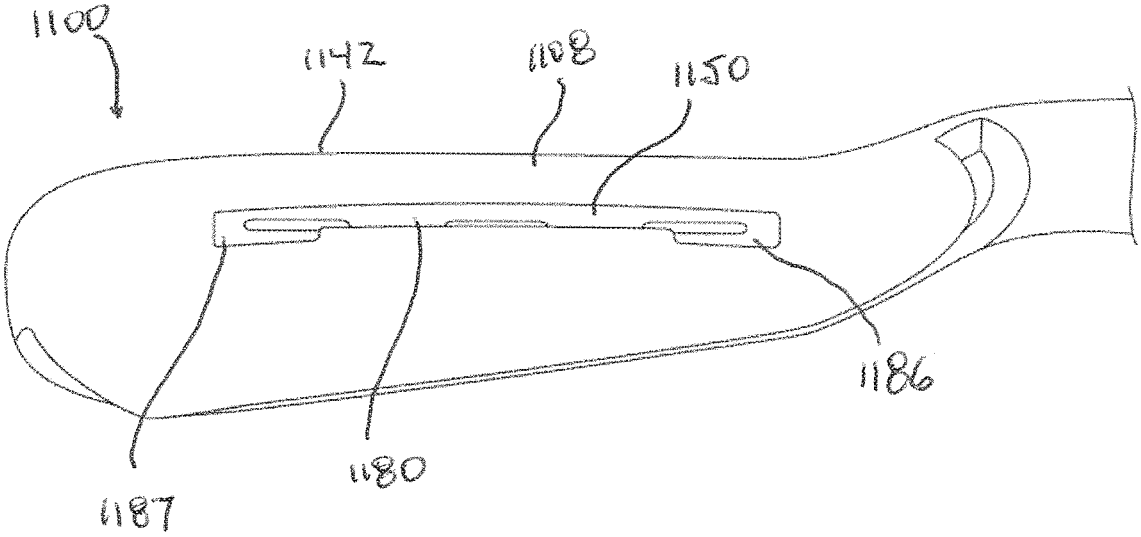

In FIG. 11J, a club head 1100 includes a single, continuous slot 1150 that includes a main portion 1180 that is substantially parallel with the leading edge 1142 of the club head, a heel relief portion 1186 and a toe relief portion 1187. Each of the heel relief portion 1186 and toe relief portion 1187 comprises a widened region of the slot 1150, i.e., the slot widths W1 of the slot 1150 in the regions of the heel relief portion 1186 and toe relief portion 1187 are larger than the width W1 of the slot in the main portion 1180. In some embodiments, the ratio of the slot widths W1 of one or both of the heel relief portion 1186 and/or the toe relief portion 1187 to the slot width W1 of the main portion 1180 may be from about 1.1 to about 5, such as from about 1.1 to about 3, such as from about 1.1 to about 2.

In each of the foregoing embodiments that include a slot 1150 formed in the sole 1108 of the club head, it is further advantageous to provide rounded or tapered edge contours in order to provide stress relief and to enhance the durability of the club head. For example, in the embodiments shown in FIGS. 11I and 11J, it is advantageous to incorporate rounded corners and edges in the heel and toe relief portions, where stress may be concentrated.

It should be noted that each of the sole slot profile embodiments shown in FIGS. 11A-J may be applied in the design of a sole channel as a flexible boundary structure on a club head. In those embodiments, the sole channel will include a forward wall, rear wall, and upper wall in the manner described above in relation to FIGS. 2A-C.

4. Alternative Channel/Slot Locations

Several of the club head embodiments described above include one or more flexible boundary structures located on the sole portion of the club head. In other, alternative embodiments, a flexible boundary structure may be included on other portions of the club head. For example, in an embodiment shown in FIG. 12A, a club head 1200 includes a flexible boundary structure in the form of a channel 1250 located at a toe region 1204 of the club head. The club head 1200 may be either a cavity back construction having a recess 1234, or the club head 1200 may be a hollow construction having an interior cavity 1220. The channel 1250 is a straight, continuous channel that is generally parallel to the edge of the striking face 1210. The channel 1250 extends into a relatively thick perimeter weighting portion in the toe region 1204 of the club head. In the embodiment shown, the channel 1250 has a channel length, L1, a channel width, W1, and a channel depth, D1.

Figure 12A:
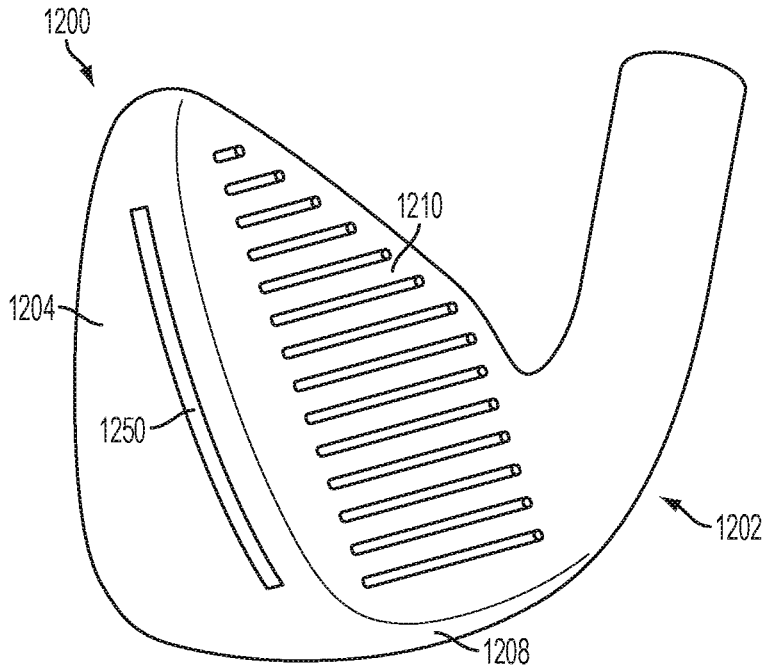
FIGS. 12A-C are elevated toe perspective views of exemplary golf club heads.

In an alternative embodiment, the club head 1200 may include a slot located at or along the toe region 1204, rather than the channel 1250 shown in FIG. 12A. In the alternative embodiment, the slot extends through the toe region 1204 of the club head and into the recess 1234 (in the case of a cavity back club head) or the interior cavity 1220 (in the case of a hollow club head). The slot may have a slot length L1 and a slot width W1.

Figure 12B:
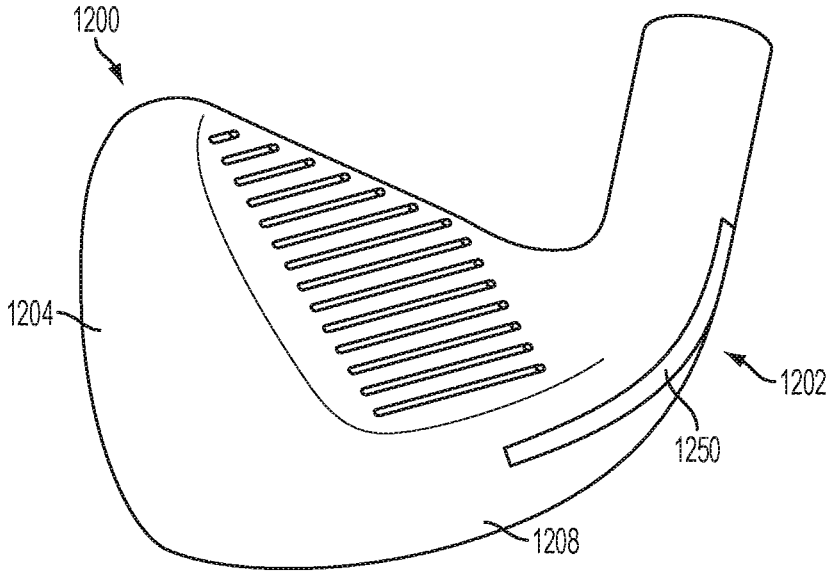
Figure 12C:
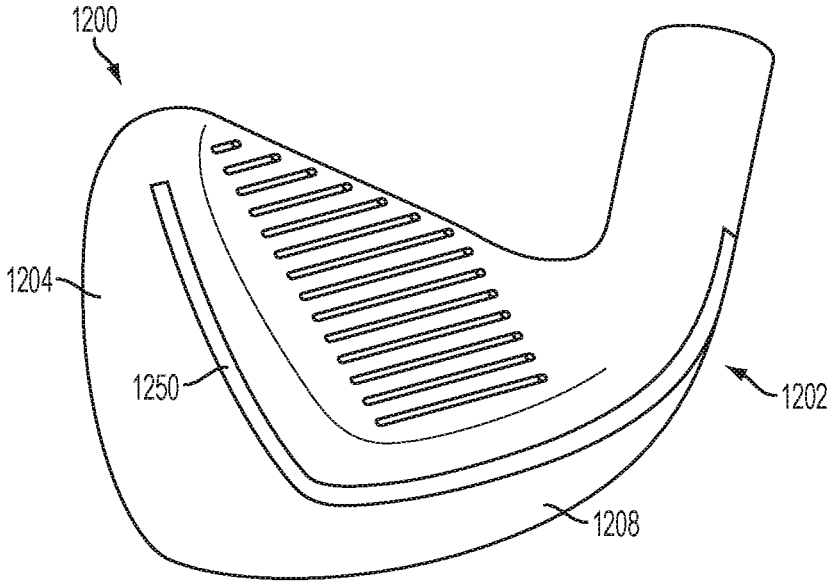

In still other embodiments, a slot, channel, or other flexible boundary structure may be located at the heel portion 102 (see FIGS. 1A-D), the top line portion 106, on the striking face 110, or at another portion of the club head. For example, in an embodiment shown in FIG. 12B, a club head 1200 includes a flexible boundary structure in the form of a channel 1250 located at a heel region 1202 of the club head. Further, in an embodiment shown in FIG. 12C, a club head 1200 includes a flexible boundary structure in the form of a channel 1250 located on the sole 1208 and extending or "wrapped" around to the toe region 1204 and heel region 1202. In those examples having a slot or a channel, the slot or channel profile may be one of the profiles shown, for example, in FIGS. 11A-H, or another profile, shape, or orientation.

Figure 13:
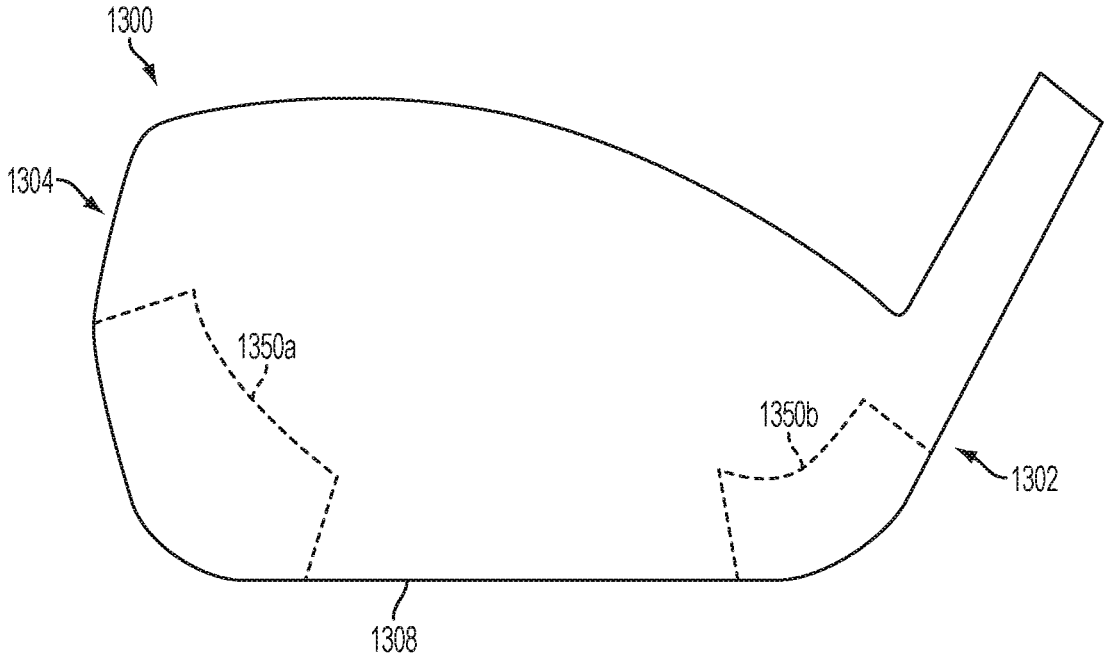
FIG. 13 is a front view of an exemplary golf club head including a schematic representation of the projections of a pair of channels on the striking face.

In still other embodiments, a plurality of flexible boundary structures may be included at separate locations on the club head. For example, another club head embodiment is shown schematically in FIG. 13, in which a first channel 1350*a* is located in the toe region 1304, and a second channel 1350*b* is located in the heel region 1302. In some embodiments, one or both of the first channel 1350*a* and second channel 1350*b* may extend onto the sole region 1308 and wrap around the club head into the toe region 1304 and/or heel region 1302, respectively. In still other embodiments, one or both of the first channel 1350*a* and second channel 1350*b* may be located fully within the toe region 1304 and/or heel region 1302, respectively.

5. Channel Depth Profiles

Figure 14A:
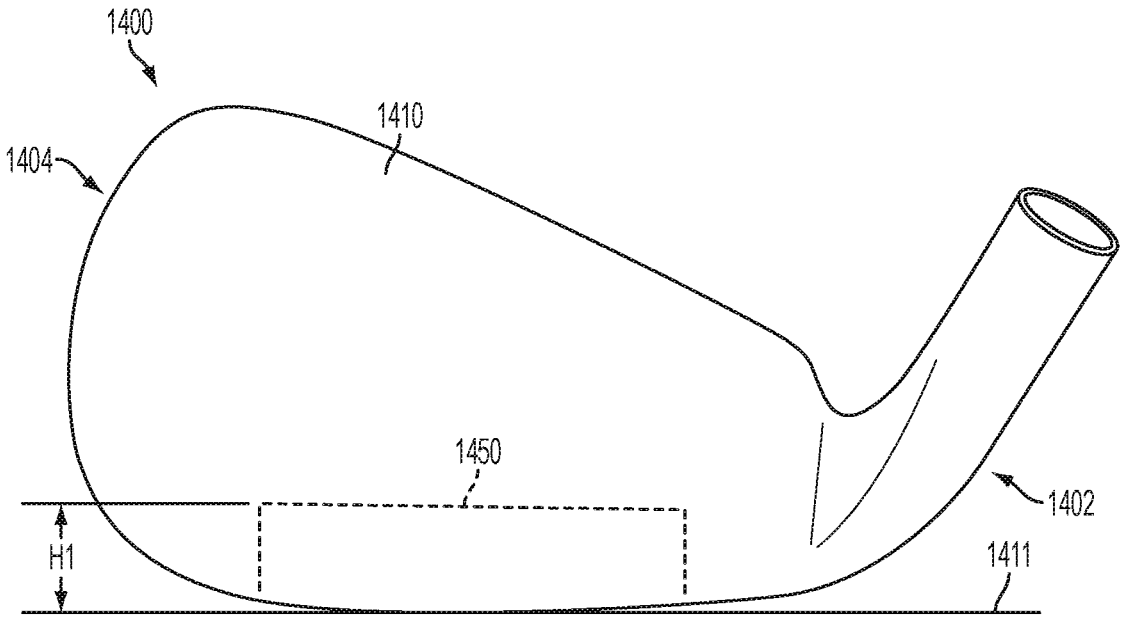
FIGS. 14A-C are front views of additional exemplary golf club heads including schematic representations of the projections of a channel on the striking face.
Figure 14B:
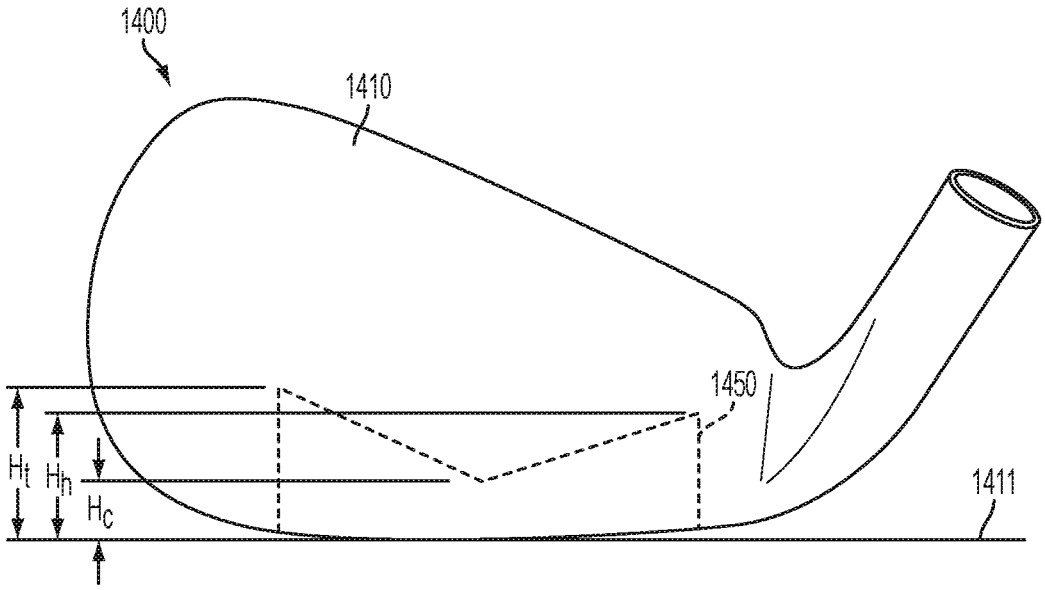
Figure 14C:
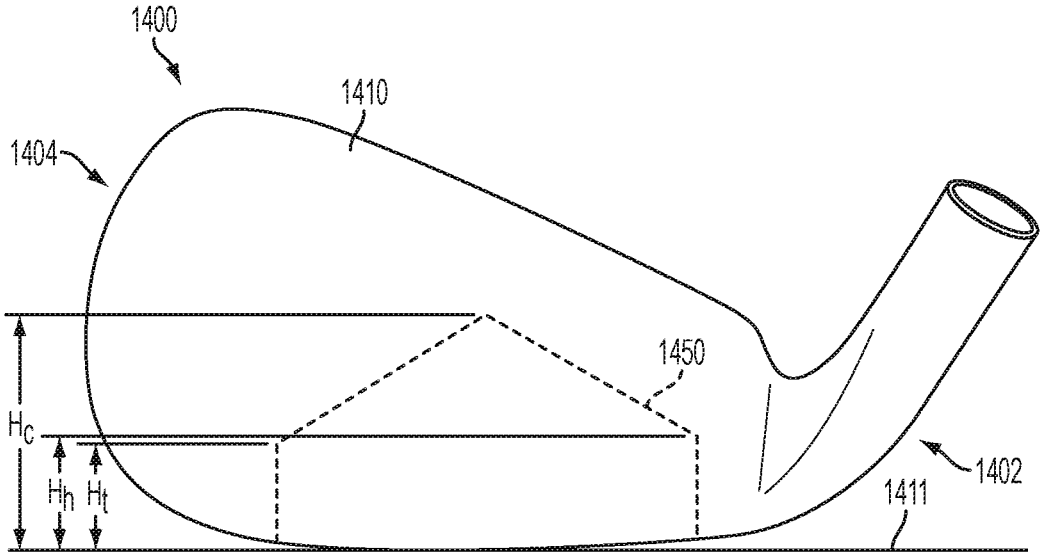

In FIGS. 2A-C, the club head 200 includes a channel 250 that has a constant depth, H1, over the full length of the channel. As noted above in the discussion of the embodiments shown in those figures, in some embodiments, the channel depth H1 may be from about 5.0 mm to about 25.0 mm, such as from about 6.0 mm to about 14.5 mm, such as from about 8.5 mm to about 13.0 mm. In one embodiment, the channel depth H1 is about 10.5 mm. In other, alternative embodiments, a club head may have a channel having a non-constant depth in order to achieve desired performance objectives. For example, several club head embodiments are shown in FIGS. 14A-C. Each of the illustrated club heads includes a channel 1450 located on the sole 1408 of the club head and extending into a sole bar (not shown) provided on the club head. For clarity, a projection of the depth profile of each of the channels is represented schematically by the dashed lines projected on the striking face 1410 of the illustrated embodiments, with it being understood that the channel 1450 is not actually visible on the striking face 1410 of an actual club head. The projected depth profiles are intended to illustrate the depth and shape of the channel 1450 within the sole bar of the club head.

The embodiment shown in FIG. 14A includes a channel 1450 having a substantially constant depth, H1 over the full heel-side to toe-side length of the channel. The embodiments shown in FIGS. 14B-C, however, include channels 1450 having a non-constant depth profile. For example, the FIG. 14B embodiment includes a channel 1450 having a toe-side depth, Ht, a heel-side depth, Hh, and a center depth, Hc, that satisfy the two inequalities: (1) Ht>Hc, and (2) Hh>Hc. On the other hand, the FIG. 14C embodiment includes a channel 1450 having a toe-side depth, Ht, a heel-side depth, Hh, and a center depth, Hc, that satisfy the two inequalities: (1) Ht<Hc, and (2) Hh<Hc.

In the embodiment shown in FIG. 14B, the peak or largest value for the depth, Ht, of the channel 1450 on the toe-side portion of the channel is located at the toe-side end of the channel, and the peak or largest value for the depth, Hh, of the channel 1450 on the heel-side portion of the channel is located at the heel-side end of the channel. In addition, the depth, Hc, of the channel at the center of the channel is a minimum depth over the full-length of the channel. The channel depth, H1, gradually increases linearly moving in each direction from the center of the channel, toward the toe region 1404 and toward the heel region 1402. In other embodiments, the peak values for the toe-side depth, Ht, and/or heel-side depth, Hh, may be located between the center of the channel and the toe-side and heel-side ends of the channel, respectively. In addition, in some embodiments, the channel depth profile may be non-linear as it progresses from the center of the channel to the ends of the channel.

In the embodiment shown in FIG. 14C the minimum value for the depth, Ht, of the channel 1450 on the toe-side portion of the channel is located at the toe-side end of the channel, and the minimum value for the depth, Hh, of the channel 1450 on the heel-side portion of the channel is located at the heel-side end of the channel. In addition, the depth, Hc, of the channel at the center of the channel is a maximum depth over the full-length of the channel. The channel depth, H1, gradually decreases linearly moving in each direction from the center of the channel, toward the toe region 1404 and toward the heel region 1402. In other embodiments, the minimum values for the toe-side depth, Ht, and/or heel-side depth, Hh, may be located between the center of the channel and the toe-side and heel-side ends of the channel, respectively. In addition, in some embodiments, the channel depth profile may be non-linear as it progresses from the center of the channel to the ends of the channel.

6. Multiple Channel Design

Figure 15A:
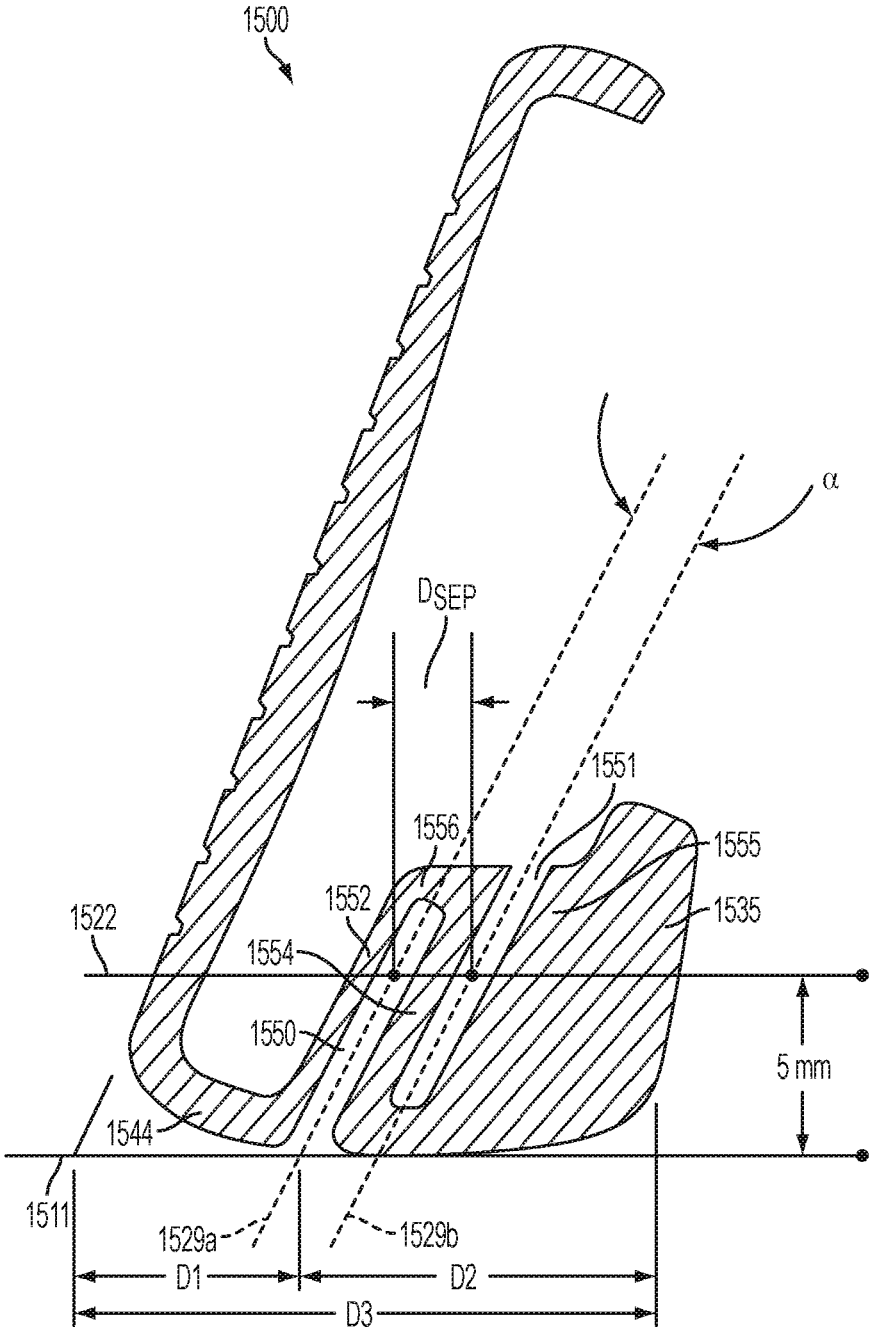
FIGS. 15A-C are cross-sectional views of exemplary golf club heads.
Figure 15B:
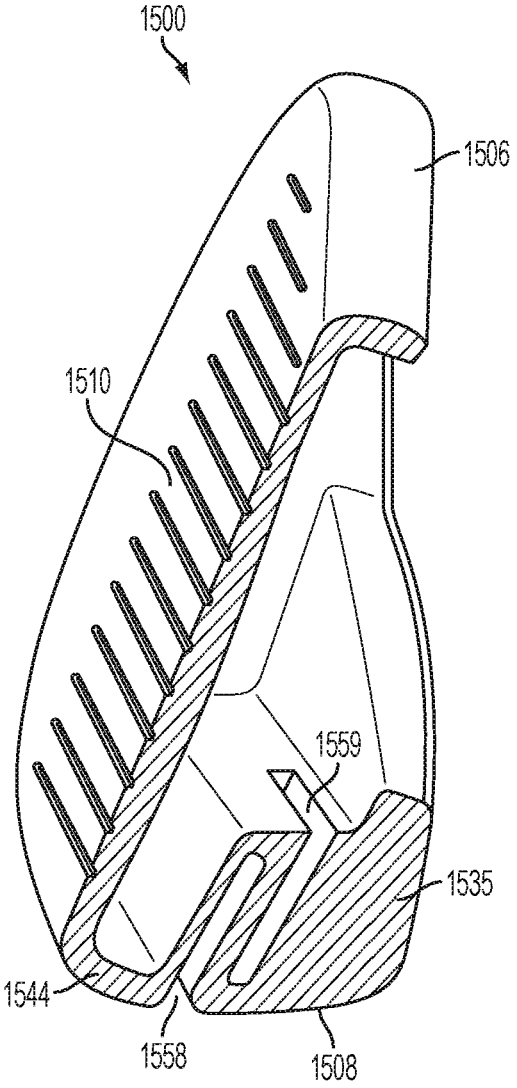

Turning next to FIGS. 15A-B, an embodiment of a club head 1500 includes a first channel 1550 and a second channel 1551 located in a sole bar 1535 of the club head. The first channel 1550 is similar to the channel described above in relation to the embodiments shown in FIGS. 2A-C, having a channel to face distance, D1, a first channel width, W1, a first channel depth, H1, and a first channel length, L1. The forward wall 1552 of the first channel defines a first hinge region 1560 having a first hinge region thickness, T1, and a second hinge region 1562 having a second hinge region thickness, T2. The forward portion 1544 of the sole defines a wall having a forward sole thickness, $T_{FS}$. The first channel 1550 further includes a rear wall 1554 and upper wall 1556. A first channel opening 1558 is located on the sole region 1508 of the club head.

The second channel 1551 is located immediately rearward of (i.e., away from the striking face 1510 from) the first channel 1550, and is defined by the first channel rear wall 1554, a second channel rear wall 1555, and a second channel lower wall 1557. A second channel opening 1559 is located on the upper surface of the sole bar 1535. The second channel 1551 has a second channel width, W2, a second channel depth, H2, and a second channel length, L2. The second channel width, W2, is measured using substantially the same method used to measure the first channel width, W1, adapted based upon the relative orientation of the second channel. The second channel depth, H2, is the vertical distance between a first horizontal plane corresponding with the second channel opening 1559 and a second horizontal plane that contains the lowermost point of the interior of the second channel 1551. The second channel length L2 is a measure of the distance on the sole bar 1535 of the club head between the toeward-most point of the second channel 1551 and the heelward-most point of the second channel 1551, without taking into account any curvature of the channel 1551. The rear wall 1554 of the first channel, which corresponds to a forward wall of the second channel 1551, defines a third hinge region 1564 having a third hinge region thickness, T3, and a fourth hinge region 1562 having a fourth hinge region thickness, T4.

The first channel 1550 and second channel 1551 are separated by a channel separation distance, $D_{SEP}$, that is determined as follows. A first channel centerline 1529*a* and second channel centerline 1529*b* are constructed in the manner described above in relation to the channel centerline shown in FIGS. 2D-E. An imaginary reference line 1522 is drawn parallel to the ground plane 1511 at a height of 5 mm above the ground plane. The distance between the points of intersection of the reference line 1522 and the first channel centerline 1529*a* and second channel centerline 1529*b* defines the channel separation distance $D_{SEP}$.

In some embodiments, the first channel centerline 1529*a* and second channel centerline 1529*b* are parallel to one another. In other embodiments, the first channel centerline 1529*a* and second channel centerline 1529*b* are oriented such that they define a channel centerline angle α therebetween. In some embodiments, the first channel centerline 1229*a* has an orientation that is steeper (i.e., closer to vertical) than the orientation of the second channel centerline 1229*b*. In those embodiments, the channel centerline angle α is oriented "upward" and may have a value ranging from slightly greater than 0° to slightly less than 90°, such as between about 1° and about 15°. In some other embodiments, the first channel centerline 1229*a* has an orientation that is shallower (i.e., closer to horizontal) than the orientation of the second channel centerline 1229*b*. In those embodiments, the channel centerline angle α is oriented "downward" and may have a value ranging from slightly greater than 0° to slightly less than 90°, such as between about 1° and about 15°.

Table 6 below lists several exemplary values for the channel separation distance $D_{SEP}$ and channel centerline angle α for several examples of clubheads that include a dual channel design according to the embodiments described herein.

TABLE 6

| | Loft | $D_{SEP}$ (mm) | α (Range) |
|---|---|---|---|
| Ex. 1 | 20-21° | 1.5-8.0 | 0 to 45 deg |
| | (4I) | 2.0-6.0 | 0 to 45 deg |
| | | 2.5-4.0 | 0 to 45 deg |
| Ex. 2 | 26-28° | 1.5-8.0 | 0 to 45 deg |
| | (6I) | 2.0-6.0 | 0 to 45 deg |
| | | 2.5-4.0 | 0 to 45 deg |

Figure 15C:
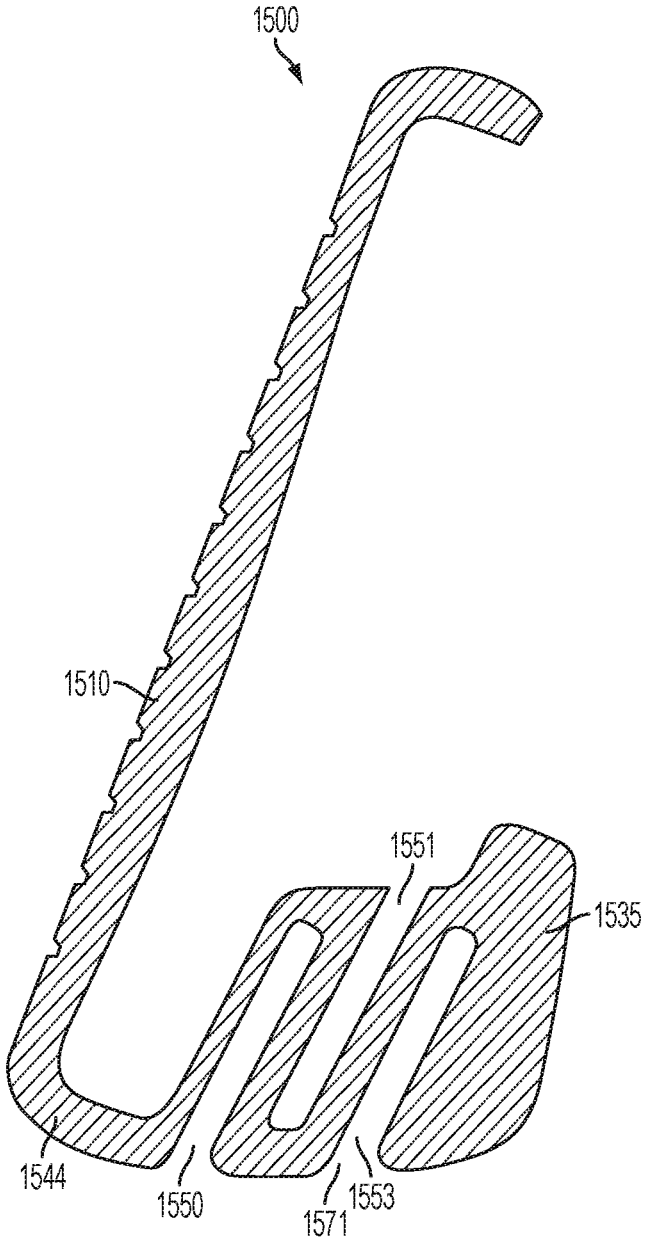

FIG. 15C shows another embodiment of a club head 1500 that includes a first channel 1550, a second channel 1551, and a third channel 1553 located in a sole bar 1535 of the club head. The first channel 1550 and second channel 1551 are similar to the channels described above in relation to the embodiments shown in FIGS. 15A-B, having channel to face distances, D1 and D2, channel widths, W1 and W2, channel depth, H1 and H2, and channel lengths, L1 and L2. The forward wall 1552 of the first channel defines a first hinge region 1560 having a first hinge region thickness, T1, and a second hinge region 1562 having a second hinge region thickness, T2. The forward portion 1544 of the sole defines a wall having a forward sole thickness, $T_{FS}$. The first channel 1550 further includes a rear wall 1554 and upper wall 1556. A first channel opening 1558 is located on the sole region 1508 of the club head.

The third channel 1553 is located immediately rearward of (i.e., away from the striking face 1510 from) the second channel 1551, and is defined by the second channel rear wall 1555, a third channel rear wall 1568, and a third channel upper wall 1569. A third channel opening 1571 is located on the lower surface of the sole bar 1535. The third channel 1553 has a third channel width, W3, a third channel depth, H3, and a third channel length, L3, each of which is measured using substantially the same method used to measure the corresponding parameters of the first channel.

7. Fillers, Damping, Vibration

In the club head embodiments described above, the described flexible boundary structures include channel and slot designs and/or the overhang member define voids or spaces within the club head. In some embodiments, these voids or spaces are left unfilled. In others, such as the embodiments illustrated in FIGS. 2H and 19C, a filler material 223 may be added into a portion of the recess 1934, the internal cavity 120, the void created under a portion of the overhang member 1996, the channel, slot, or other flexible boundary structure. One or more fillers may be added to achieve desired performance objectives, including preventing unwanted materials (e.g., water, grass, dirt, etc.) from entering the channel or slot, or obtaining desired changes to the sound and feel of the club head by damping vibrations that occur when the club head strikes a golf ball.

Examples of materials that may be suitable for use as a filler to be placed into a slot, channel, or other flexible boundary structure include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd. Certain embodiments utilize non-expanding foam such as injection foam, urethane, two part foam, or chemical initiated expansion foam. Other embodiments may incorporate encapsulated particles having a particle size between about 2 μm and about 90 μm.

In some embodiments the filler material has a density between about 0.03 g/cc and about 0.19 g/cc. In yet another embodiment the filler material may have a modulus of elasticity ranging from about 0.001 GPa to about 25 GPa, and/or a durometer ranging from about 5 to about 95 on a Shore D scale. In other examples, gels or liquids can be used, and softer materials which are better characterized on a Shore A or other scale can be used. The Shore D hardness on a polymer is measured in accordance with the ASTM (American Society for Testing and Materials) test D2240. In a further embodiment the filler material has a hardness range of about 15-85 Shore OO hardness or about 80 Shore OO hardness or less.

In some embodiments, a solid filler material may be press-fit or adhesively bonded into a portion of the aforementioned voids, recesses, cavity, or spaces within the club head, slot, channel, or other flexible boundary structure. In other embodiments, a filler material may poured, injected, or otherwise inserted into a portion of the aforementioned voids, recesses, cavity, or spaces within the club head, slot or channel and allowed to cure in place, forming a sufficiently hardened or resilient outer surface. In still other embodiments, a filler material may be placed into a portion of the aforementioned voids, recesses, cavity, or spaces within the club head, slot or channel and sealed in place with a resilient cap or other structure formed of a metal, metal alloy, metallic, composite, hard plastic, resilient elastomeric, or other suitable material.

In some embodiments, the portion of the filler 223 or cap that is exposed within the channel 250 has a generally convex shape and is disposed within the channel such that the lowermost portion of the filler 223 or cap is displaced by a gap, $D_F$, below the lowermost surface of the immediately adjacent portions of the body of the clubhead 200. (See, e.g., FIG. 2H). The gap $D_F$ is preferably sufficiently large to prevent excessive wear and tear on the filler 223 or cap that is exposed within the channel due to striking the ground or other objects. In this way, the filler 223 or cap is not exposed to excessive wear due to contact with the ground during a swing that would otherwise occur if the filler 223 or cap were located flush with the adjacent portions of the clubhead body.

Figure 19C:
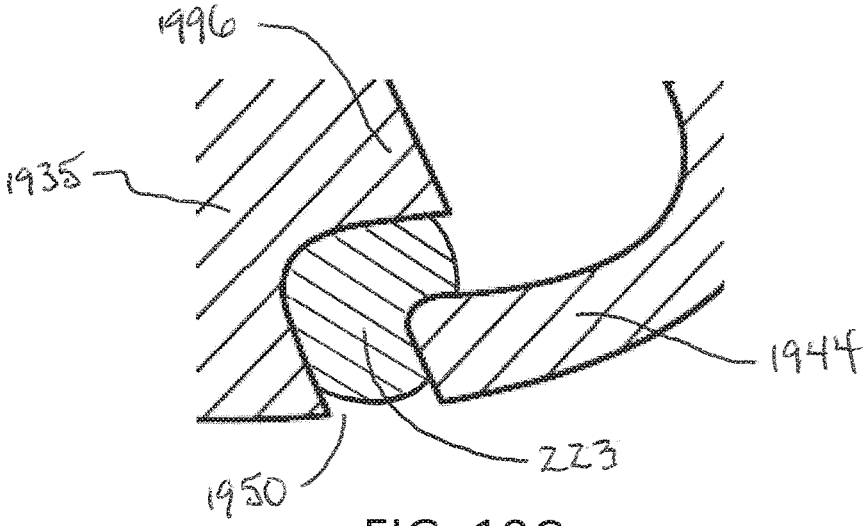
FIG. 19C is a close-up cross-sectional view of a golf club head having a slot including a filler material.

In the embodiment shown in FIG. 19C, the club head 1900 includes a slot 1950 and an overhang 1996. Whereas the slot 1950 provides a passage through the sole 1908 and into a rear void (e.g., a recess 1934 or internal cavity 120) of the club head, the overhang 1996 extends from the sole bar 1935 toward the rear surface of the striking plate thereby creating a recess under the overhang 1996, and may partially blocks the passage. In certain embodiments, the overhang 1996 serves as a backstop to partially trap or retain a viscous filler material 223 that is injected or otherwise inserted into the aforementioned voids, recesses, cavity, spaces, or slot 1950 during manufacture of the club head. Accordingly, during manufacture, the viscous filler material 223 may be injected through the slot 1950 or an aperture in the club head 1900. When injected through the slot 1950 the viscous filler material 223 may, encounter the overhang 1996 which will stop the generally upward flow of the filler material 223 and redirect the flow generally toward the striking face 1910, thereby reducing the amount of filler material 223 needed to seal the slot 1950. In certain embodiments the filler material 223 may extend into the recess formed under the overhang member 1996, extend between the overhang member 1996 and the rear surface of the face, and/or fill all of, or a portion of, the cavity recess 1934 or the internal cavity 120.

8. Golf Club Sets

Figure 16:
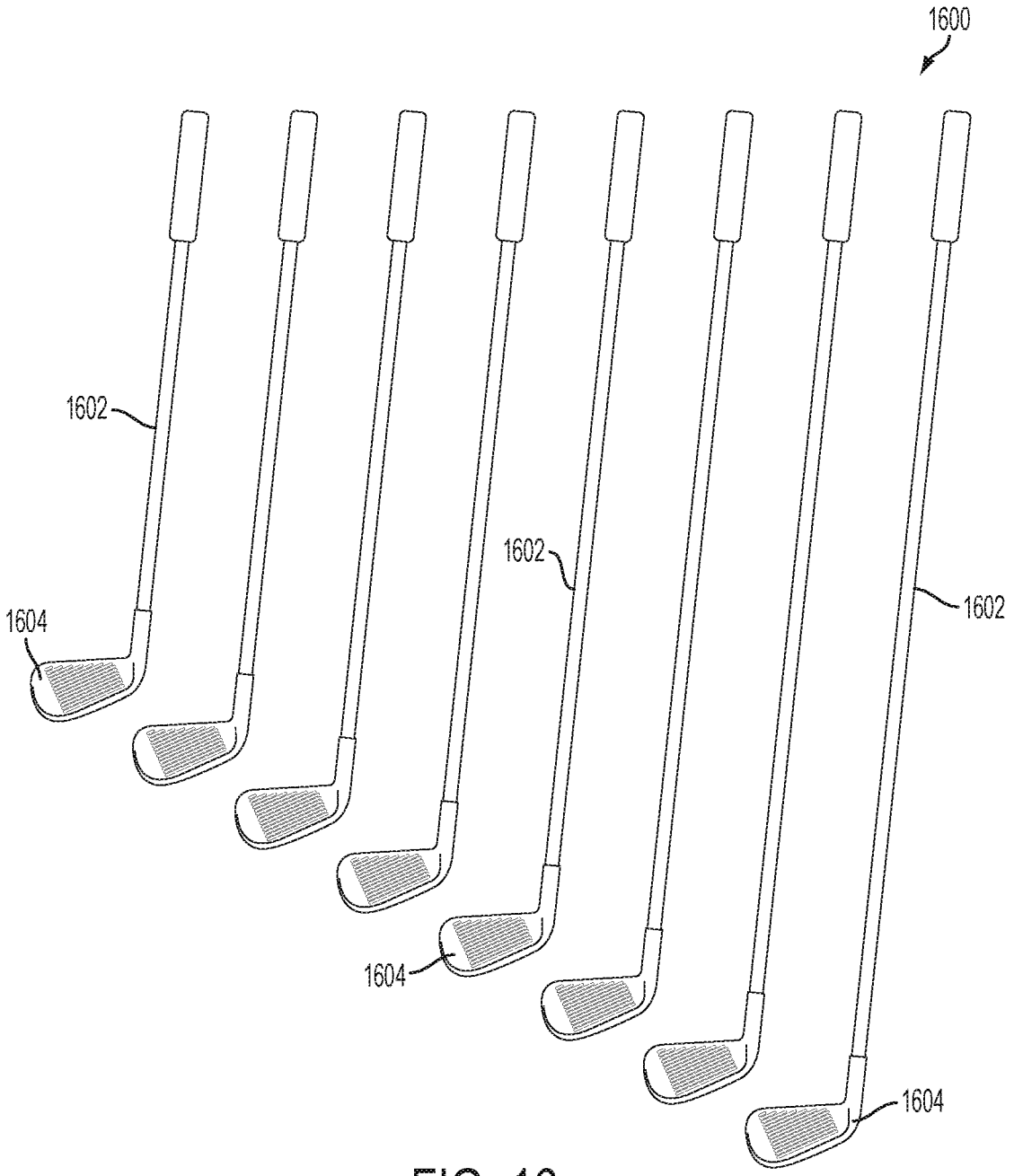
FIG. 16 is an illustration of an embodiment of a golf club set.
Figure 17A:
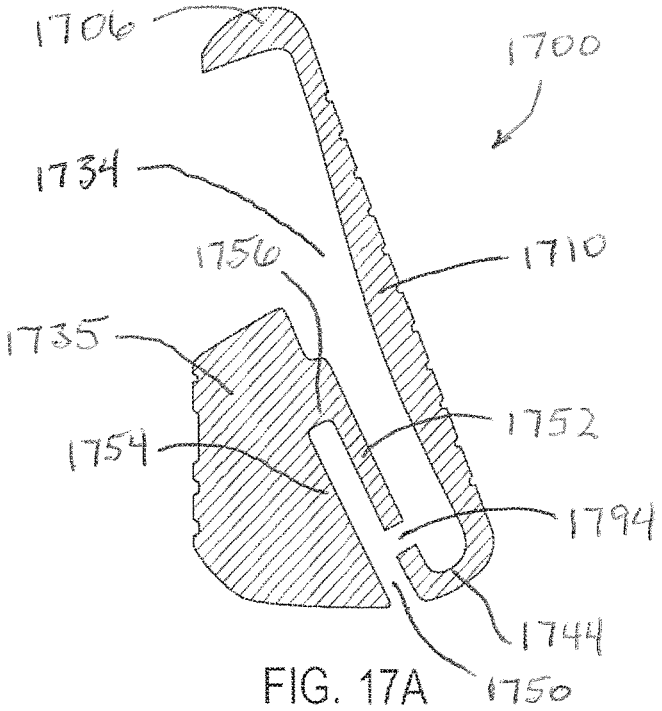
FIG. 17A is a cross-sectional view of another embodiment of a golf club head.
Figure 17B:
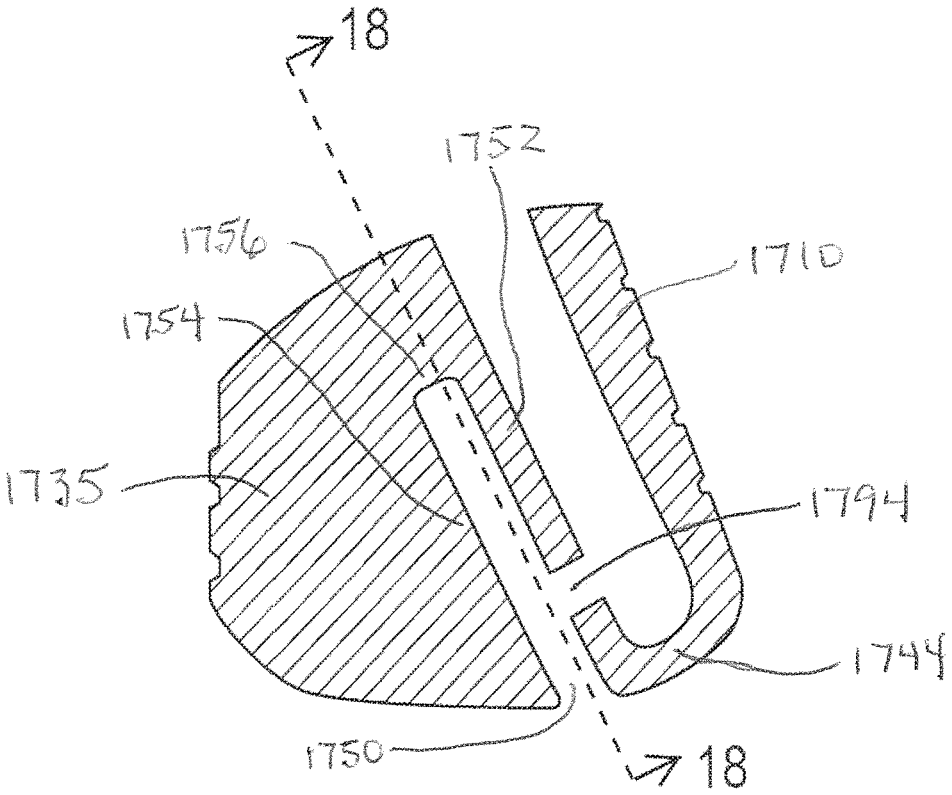
FIG. 17B is a close-up cross-sectional view of a portion of the golf club head shown in FIG. 17A.

Referring now to FIG. 16, there is illustrated a golf club set 1600. The golf club set 1600 may include one or more types of golf club heads 1604, including cavity back, muscleback, blades, hollow clubs or other types of club heads typically used as part of a set. The golf club set 1600 may have varying performance characteristics between clubs. For example, shafts 1602 may vary in length, swing weight may vary, and one or more of the performance characteristics noted above may vary. As one example, at least a portion of the golf clubs of set 1600 may include hollow clubs. Individual hollow clubs may include hollow areas that vary in volume. Furthermore, hollow areas may be filled with foam, polymer or other types of materials, and the particular type of filler materials may vary from club to club. Additionally, the club types within set 1600 may vary, such as by including some hollow clubs, some cavity back clubs and some muscleback clubs within one set.

In several embodiments of the golf club set 1600, at least one of the golf clubs included in the set 1600 has a club head 1604 having a flexible boundary structure, such as a slot, a channel, or other structure, whereas at least one other of the golf clubs included in the set 1600 has a club head 1604 that does not have a flexible boundary structure. For example, in some embodiments, at least one of the golf clubs included in the set 1600 has a club head 1604 having a slot or channel such as one or more of the club head embodiments described herein in reference to FIGS. 2A-H through 15A-C, and at least one other of the golf clubs included in the set 1600 does not have a flexible boundary structure. In some embodiments, a set of 8 or more golf clubs may include up to 2, up to 3, up to 4, up to 5, up to 6, or up to 7 golf clubs with club heads having a flexible boundary structure, with the remainder having no flexible boundary structure.

Tables 7A through 7D illustrate four particular embodiments of golf club sets 1600 having performance characteristics that vary between clubs within the set. However, it is worthwhile to note that these are just four embodiments and the claimed subject matter is not limited in this respect.

TABLE 7A

| Iron # | 3 | 4 | 5 | 6 | 7 | 8 | 9 | PW |
|---|---|---|---|---|---|---|---|---|
| Loft (Range) | 17-19° | 20-21° | 23-24° | 26-28° | 30-32° | 34-36° | 39-41° | 44-46° |
| Head Constr. | Cavity-back | Cavity-back | Cavity-back | Cavity-back | Cavity-back | Cavity-back | Cavity-back | Cavity-back |
| FBS | Y | Y | Y | N | N | N | N | N |
| FBS Type | Channel | Channel | Channel | | | | | |
| FBS Location | Sole | Sole | Sole | | | | | |
| FBS Shape | FIGS. 2A-C | FIGS. 2A-C | FIGS. 2A-C | | | | | |

TABLE 7B

| Iron # | 3 | 4 | 5 | 6 | 7 | 8 | 9 | PW |
|---|---|---|---|---|---|---|---|---|
| Loft (Range) | 17-19° | 20-21° | 23-24° | 26-28° | 30-32° | 34-36° | 39-41° | 44-46° |
| Head Constr. | Hollow | Hollow | Hollow | Cavity-back | Cavity-back | Cavity-back | Cavity-back | Cavity-back |
| FBS | Y | Y | Y | Y | Y | N | N | N |
| FBS Type | Channel | Channel | Channel | Channel | Channel | | | |
| FBS Location | Sole | Sole | Sole | Sole | Sole | | | |
| FBS Shape | FIGS. 2A-C | FIGS. 2A-C | FIGS. 2A-C | FIGS. 2A-C | FIGS. 2A-C | | | |

TABLE 7C

| Iron # | 4 | 5 | 6 | 7 | 8 | 9 | PW | AW | SW | LW |
|---|---|---|---|---|---|---|---|---|---|---|
| Loft (Range) | 20-21° | 23-24° | 26-28° | 30-32° | 34-36° | 39-41° | 44-46° | 49-51° | 54-56° | 59-61° |
| Head Constr. | Hollow | Hollow | Cav-back | Cav-back | Cav-back | Cav-back | Cav-back | Cav-back | Cav-back | Cav-back |
| FBS | Y | Y | Y | Y | Y | Y | Y | Y | N | N |
| FBS Type | Channel | Channel | Channel | Channel | Channel | Channel | Channel | Channel | | |
| FBS Location | Sole | Sole | Sole | Sole | Sole | Sole | Sole | Sole | | |
| FBS Shape | FIGS. 2A-C | FIGS. 2A-C | FIGS. 2A-C | FIGS. 2A-C | FIGS. 2A-C | FIGS. 2A-C | FIGS. 2A-C | FIGS. 2A-C | | |

TABLE 7D

| Iron # | 3 | 4 | 5 | 6 | 7 | 8 | 9 | PW |
|---|---|---|---|---|---|---|---|---|
| Loft (Range) | 17-19° | 20-21° | 23-24° | 26-28° | 30-32° | 34-36° | 39-41° | 44-46° |
| Head Constr. | Hollow | Hollow | Hollow | Cav-back | Cav-back | Cav-back | Cav-back | Cav-back |
| FBS | Y | Y | Y | Y | Y | N | N | N |
| FBS Type | Channel | Channel | Channel | Channel | Channel | | | |
| FBS Location | Sole | Sole | Sole | Sole | Sole | | | |
| FBS Shape | FIGS. 2A-C | FIGS. 2A-C | FIGS. 2A-C | FIGS. 2A-C | FIGS. 2A-C | | | |

As reflected in Tables 7A through 7D, there are unique compositions of golf clubs within a multi-club set, one or more of which include a flexible boundary structure (e.g., a channel) and one or more of which do not include a flexible boundary structure. (It should be understood that the golf club set may have fewer or more irons than set forth in Tables 7A through 7D.) It is generally preferable to achieve a consistent average gapping distance from club to club. In this way, the golfer is provided with a full range of consistent and increasing club shot distances so that the golfer can select a club or iron for the distance required by a particular shot or situation. Typically, the average gapping distance from club to club in a set of irons for an average player is about 8-10 yards. As set forth herein, the unique inclusion of individual clubs having a flexible boundary structure with those not having a flexible boundary structure from the LW to the 3-iron helps provide for an average gapping distance for an average player of about 11-15 yards from club to club, respectively. In this respect, the embodiments herein provide consistency as well as an overall greater range of distances for the golfer.

Other parameters may contribute to overall greater gap distance in the set, and greater ball speed and distance for each individual iron. These parameters include shaft length, face thickness, face area, weight distribution (and resultant club head moment of inertia ("MOI") and center of gravity ("CG") location), and others. In addition, still other parameters may contribute to performance, playability, forgiveness or other features of golf clubs contained within the set. These parameters include topline thicknesses (and topline thickness progression within the set), swing weights, and sole widths. Descriptions of the contributions of these parameters to the performance of golf clubs within a set of golf clubs is provided in United States Published Patent Application No. 2011/0159981, which is hereby incorporated by reference in its entirety.

9. Club Head Performance

The inventors of the club heads described herein investigated the effect of incorporating channels, slots, and other flexible boundary structures into the perimeter regions of iron type club heads. Iron golf club head designs were modeled using commercially available computer aided modeling and meshing software, such as Pro/Engineer by Parametric Technology Corporation for modeling and Hypermesh by Altair Engineering for meshing. The golf club head designs were analyzed using finite element analysis (FEA) software, such as the finite element analysis features available with many commercially available computer aided design and modeling software programs, or stand-alone FEA software, such as the ABAQUS software suite by ABAQUS, Inc. Under simulation, models of iron type golf club heads having flexible boundary structures incorporated into perimeter regions of the club heads were observed to produce relatively higher values of COR and CT when compared to similarly constructed golf club heads that do not include a flexible boundary structure.

In addition, golf clubheads having channels were constructed to determine the effect of incorporating a channel into the perimeter regions of the clubheads. COR measurements were taken of two golf club heads. The first club head did not include a flexible boundary structure. The second club head included a straight, continuous channel located in the sole of the club head, and having the following parameters set forth in Table 8:

TABLE 8

| | |
|---|---|
| Face to channel distance (D1) | 8.7 mm |
| Clubhead depth ($D_{CH}$) | 27.9 mm |
| Channel width (W1) | 1.5 mm |
| Channel depth (H1) | 12.3 mm |
| First hinge thickness (T1) | 1.0 mm |
| Second hinge thickness (T2) | 1.0 mm |
| Forward sole min thickness ($T_{FS}$) | 2.0 mm |
| Sole bar max thickness ($T_{SB}$) | 15.3 mm |
| Channel length (L1) | 54 mm |
| Sole Length ($L_B$) | 82.2 mm |
| Ratio $D1/D_{CH}$ | 0.31 |
| Ratio $T_{FS}/T_{SB}$ | 0.13 |
| Ratio $L1/L_B$ | 0.66 |

The golf clubs were otherwise identical. COR testing was performed at several locations on the striking face of each of the clubheads, and the following results were obtained:

TABLE 9

| | Without Channel | | With Channel | | |
|---|---|---|---|---|---|
| | Location | Relative COR | Location | Relative COR | COR Gain |
| Toe | −10 mm | −0.045 | −10 mm | −0.026 | 0.019 |
| Toe | −5 mm | −0.017 | −5 mm | −0.004 | 0.013 |
| ISL | 0 | −0.009 | 0 | 0.005 | 0.014 |
| Heel | 5 mm | −0.015 | 5 mm | −0.004 | 0.011 |
| Heel | 10 mm | −0.033 | 10 mm | −0.014 | 0.019 |
| Crown | 5 mm | −0.052 | 5 mm | −0.022 | 0.030 |
| Crown | 2.5 mm | −0.011 | 2.5 mm | 0.002 | 0.013 |
| ISL | 0 | −0.009 | 0 | 0.005 | 0.014 |
| Sole | −2.5 mm | −0.031 | −2.5 mm | −0.004 | 0.027 |
| Sole | −5 mm | −0.045 | −5 mm | −0.014 | 0.031 |

In Table 9, the location "ISL" refers to the ideal striking location. The references to locations at distances toward the "Toe" and "Heel" refer to horizontal distances within the striking face plane from the ISL toward the toe and heel of the clubhead. The references to locations at distances toward the "Crown" and "Sole" refer to distances toward the crown and sole of the clubhead along a line defined by the intersection of the striking face plane and a perpendicular vertical plane. Accordingly, the flexible boundary structure was responsible for an increase in the COR of the club head of from about 0.11 to about 0.31, depending upon the location on the striking face of the clubhead.

In view of the many possible embodiments to which the principles of the disclosed invention may be applied, it should be recognized that the illustrated embodiments are only preferred examples of the invention and should not be taken as limiting the scope of the invention. It will be evident that various modifications may be made thereto without departing from the broader spirit and scope of the invention as set forth. The specification and drawings are, accordingly, to be regarded in an illustrative sense rather than a restrictive sense.

We claim:

1. A clubhead for an iron-type golf club, comprising:

an iron-type body having a heel portion, a toe portion, a top-line portion, a face portion having a variable face thickness varying from a minimum face thickness to a maximum face thickness, and a sole portion extending rearwardly from a lower end of said face portion, wherein:

the face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane, wherein a positive x-axis extends toward the heel portion from the origin, a positive y-axis extends rearwardly from the origin, and a positive z-axis extends upwardly from the origin;

the face portion defines a striking face plane that intersects the ground plane along a face projection line;

the body includes a central region which extends along the x-axis from a location greater than about −25 mm to a location less than about 25 mm;

the sole portion contained within the central region includes a thinned forward sole region located adjacent to the face portion and within a distance of 17 mm measured horizontally in the direction of the y-axis from the face projection line, and a thickened rearward sole region located behind the thinned forward sole region, with the thinned forward sole region defining a wall having a minimum forward sole thickness $T_{FS}$ and the thickened rearward sole region having a maximum sole bar thickness $T_{SB}$;

at least one vertical section within the central region and parallel to the y-axis has (a) the minimum forward sole thickness $T_{FS}$ no more than 3.0 mm and less than the maximum face thickness, (b) the maximum sole bar thickness $T_{SB}$ at least 7.0 mm, and (c) a ratio of the minimum forward sole thickness $T_{FS}$ to the maximum sole bar thickness $T_{SB}$ is 0.04-0.50;

the thickened rearward sole region has an overhang member projecting toward the face portion, without touching the face portion, and overhanging a portion of the thinned forward sole region, thereby creating a recess under the overhang member.

2. The clubhead of claim 1, wherein an elastomeric material at least partially fills the recess and the elastomeric material is an injected cure-in-place material.

3. The clubhead of claim 2, wherein the elastomeric material contacts a portion of a rear surface of the face portion.

4. The clubhead of claim 3, wherein each vertical section within the central region and parallel to the y-axis has (a) the minimum forward sole thickness $T_{FS}$ no more than 3.0 mm and less than the maximum face thickness, (b) the maximum sole bar thickness $T_{SB}$ at least 7.0 mm, and (c) the ratio of the minimum forward sole thickness $T_{FS}$ to the maximum sole bar thickness $T_{SB}$ is 0.04-0.50.

5. The clubhead of claim 3, wherein the elastomeric material contains an inorganic filler material.

6. The clubhead of claim 3, wherein the elastomeric material is a urethane.

7. The clubhead of claim 3, wherein the elastomeric material contains a filler material with a particle size between about 2 μm and about 90 μm.

8. The clubhead of claim 3, wherein the clubhead is a cavity back iron and the cavity contains a badge attached to a rear surface of the face portion and extending over a portion of the thickened rearward sole region.

9. The clubhead of claim 3, wherein the elastomeric material has a density between about 0.03 g/cc and about 0.19 g/cc, a modulus of elasticity ranging from about 0.001 GPa to about 25 GPa, and a durometer ranging from about 5 to about 95 on a Shore D scale.

10. The clubhead of claim 3, wherein at least one vertical section within the central region and parallel to the y-axis has (a) the minimum forward sole thickness $T_{FS}$ no more than 2.5 mm, and (b) the ratio of the minimum forward sole thickness $T_{FS}$ to the maximum sole bar thickness $T_{SB}$ of 0.06-0.35.

11. The clubhead of claim 10, wherein the minimum face thickness is no more than about 2.0 mm.

12. The clubhead of claim 10, wherein each vertical section within the central region and parallel to the y-axis has (a) the minimum forward sole thickness $T_{FS}$ no more than 2.5 mm, and (b) the ratio of the minimum forward sole thickness $T_{FS}$ to the maximum sole bar thickness $T_{SB}$ of 0.06-0.35.

13. The clubhead of claim 10, wherein the face portion is composed of a face material that is different from the remainder of the body and wherein the face portion and the body portion are joined by welding.

14. The clubhead of claim 10, wherein a portion of the elastomeric material contacts both the rear surface of the face portion and the overhang member.

15. A clubhead for an iron-type golf club, comprising:

an iron-type body having a heel portion, a toe portion, a top-line portion, a face portion having a variable face thickness varying from a minimum face thickness, of no more than 2.0 mm, to a maximum face thickness, and a sole portion extending rearwardly from a lower end of said face portion, wherein:

the face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane, wherein a positive x-axis extends toward the heel portion from the origin, a positive y-axis extends rearwardly from the origin, and a positive z-axis extends upwardly from the origin;

the face portion defines a striking face plane that intersects the ground plane along a face projection line;

the body includes a central region which extends along the x-axis from a location greater than about −25 mm to a location less than about 25 mm;

the sole portion contained within the central region includes a thinned forward sole region located adjacent to the face portion and within a distance of 17 mm measured horizontally in the direction of the y-axis from the face projection line, and a thickened rearward sole region located behind the thinned forward sole region, with the thinned forward sole region defining a wall having a minimum forward sole thickness $T_{FS}$ and the thickened rearward sole region having a maximum sole bar thickness $T_{SB}$;

at least one vertical section within the central region and parallel to the y-axis has (a) the minimum forward sole thickness $T_{FS}$ no more than 2.5 mm and less than the maximum face thickness, (b) the maximum sole bar thickness $T_{SB}$ at least 7.0 mm, and (c) a ratio of the minimum forward sole thickness $T_{FS}$ to the maximum sole bar thickness $T_{SB}$ is 0.04-0.35;

the thickened rearward sole region has an overhang member projecting toward the face portion, without touching the face portion, and overhanging a portion of the thinned forward sole region, thereby creating a recess under the overhang member.

16. The clubhead of claim 15, wherein the face portion is composed of a face material that is different from the remainder of the body and wherein the face portion and the body portion are joined by welding.

17. The clubhead of claim 15, wherein an elastomeric material (a) at least partially fills the recess and contacts a portion of a rear surface of the face portion, and (b) contacts both the rear surface of the face portion and the overhang member.

18. The clubhead of claim 15, wherein an elastomeric material at least partially fills the recess and the elastomeric material contains an inorganic filler material with a particle size between about 2 μm and about 90 μm.

19. The clubhead of claim 15, wherein the clubhead is a cavity back iron and the cavity contains a badge attached to a rear surface of the face portion and extending over a portion of the thickened rearward sole region.

20. A clubhead for an iron-type golf club, comprising:

an iron-type body having a heel portion, a toe portion, a top-line portion, a face portion having a variable face thickness varying from a minimum face thickness to a maximum face thickness, and a sole portion extending rearwardly from a lower end of said face portion, wherein:

the face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane, wherein a positive x-axis extends toward the heel portion from the origin, a positive y-axis extends rearwardly from the origin, and a positive z-axis extends upwardly from the origin;

the face portion defines a striking face plane that intersects the ground plane along a face projection line;

the body includes a central region which extends along the x-axis from a location greater than about −25 mm to a location less than about 25 mm;

the sole portion contained within the central region includes a thinned forward sole region located adjacent to the face portion and within a distance of 17 mm measured horizontally in the direction of the y-axis from the face projection line, and a thickened rearward sole region located behind the thinned forward sole region, with the thinned forward sole region defining a wall having a minimum forward sole thickness $T_{FS}$ and the thickened rearward sole region having a maximum sole bar thickness $T_{SB}$;

at least one vertical section within the central region and parallel to the y-axis has (a) the minimum forward sole thickness $T_{FS}$ no more than 3.0 mm and less than the maximum face thickness, (b) the maximum sole bar thickness $T_{SB}$ at least 7.0 mm, and (c) a ratio of the minimum forward sole thickness $T_{FS}$ to the maximum sole bar thickness $T_{SB}$ is 0.04-0.50;

the thickened rearward sole region has an overhang member projecting toward the face portion, without touching the face portion, and overhanging a portion of the thinned forward sole region.

* * * * *